US007273381B2

(12) United States Patent
Ito

(10) Patent No.: US 7,273,381 B2
(45) Date of Patent: Sep. 25, 2007

(54) PLUG CONNECTOR

(75) Inventor: Toshiyasu Ito, Tougane (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 11/585,823

(22) Filed: Oct. 25, 2006

(65) Prior Publication Data

US 2007/0099514 A1 May 3, 2007

(30) Foreign Application Priority Data

Oct. 27, 2005 (JP) ..... 2005-313054
Sep. 1, 2006 (JP) ..... 2006-238081

(51) Int. Cl.
*H01R 12/00* (2006.01)

(52) U.S. Cl. ..... 439/79

(58) Field of Classification Search ..... 439/79, 439/660, 59, 637

See application file for complete search history.

(56) References Cited

U.S. PATENT DOCUMENTS 4,189,200 A 2/1980 Yeager et al.
4,630,874 A 12/1986 Renn et al.
5,458,506 A 10/1995 Yamaguchi et al.
5,580,257 A * 12/1996 Harwath ..... 439/108
5,692,910 A 12/1997 Mittal
5,709,573 A 1/1998 McClure
5,953,815 A * 9/1999 Kaminski et al. ..... 29/860
5,954,521 A * 9/1999 Yang ..... 439/59

(Continued)

FOREIGN PATENT DOCUMENTS

EP 0 933 837 A1 8/1999

(Continued)

OTHER PUBLICATIONS

Chinese Office Action and English Translation for Chinese Patent Application No. 2004100807089, dated Mar. 10, 2006.

(Continued)

*Primary Examiner*—Tulsidas C. Patel
*Assistant Examiner*—Vladimir Imas
(74) *Attorney, Agent, or Firm*—Finnegan, Henderson, Farabow, Garrett & Dunner, LLP

(57) ABSTRACT

A plug connector for electrically connecting a printed wiring board with a card-edge connector includes a first connector-contact arrangement and a second connector-contact arrangement. The first connector-contact arrangement is inserted to the card-edge connector and includes a first blade with a front surface having a recessed surface partly recessed therefrom and a plurality of first contact components arranged parallel one with another in the first blade. The second connector-contact arrangement is inserted to a card-edge connector and includes a second blade with a front surface having a recessed surface partly recessed therefrom and a plurality of second contact components arranged parallel one with another in the second blade. When a plug connector is formed by assembling the first and second connector-contact arrangements together, the first connector-contact arrangement is electrically connected with one printed wiring board through press-contact or push-contact while the second connector-contact arrangement is electrically connected therewith through clamp-contact.

11 Claims, 17 Drawing Sheets

U.S. PATENT DOCUMENTS

| | | | | |
|---|---|---|---|---|
| 6,099,346 | A | 8/2000 | Hashiguchi et al. | |
| 6,123,558 | A | 9/2000 | Shibata | |
| 6,126,472 | A * | 10/2000 | Choy | 439/328 |
| 6,176,737 | B1 * | 1/2001 | Choy | 439/541.5 |
| 6,203,345 | B1 | 3/2001 | Roque et al. | |
| 6,210,174 | B1 | 4/2001 | Pei et al. | |
| 6,210,209 | B1 | 4/2001 | Wu et al. | |
| 6,261,106 | B1 * | 7/2001 | Tung | 439/79 |
| 6,315,616 | B1 | 11/2001 | Hayashi | |
| 6,383,017 | B1 | 5/2002 | Takayasu | |
| 6,431,897 | B1 | 8/2002 | Hashiguchi et al. | |
| 6,506,074 | B2 * | 1/2003 | Hashimoto | 439/541.5 |
| 6,755,682 | B2 | 6/2004 | Kunishi et al. | |
| 6,767,233 | B2 | 7/2004 | Tsunematsu | |
| 6,790,074 | B1 | 9/2004 | Chiu | |
| 6,821,158 | B2 | 11/2004 | Iida et al. | |
| 6,851,968 | B2 | 2/2005 | Tsunematsu | |
| 6,855,009 | B2 | 2/2005 | Nishiyama | |
| 6,863,559 | B2 | 3/2005 | Yu | |
| 6,869,307 | B2 | 3/2005 | Endo | |
| 6,921,274 | B2 | 7/2005 | Yu | |
| 6,971,908 | B2 | 12/2005 | Shiu et al. | |
| 7,101,188 | B1 * | 9/2006 | Summers et al. | 439/59 |
| 2002/0119704 | A1 * | 8/2002 | Ito et al. | 439/636 |
| 2003/0092310 | A1 | 5/2003 | Kunishi et al. | |
| 2005/0075004 | A1 * | 4/2005 | Endou et al. | 439/495 |
| 2006/0172590 | A1 | 8/2006 | Yamada et al. | |
| 2006/0189175 | A1 * | 8/2006 | Kinsley | 439/66 |

FOREIGN PATENT DOCUMENTS

| | | | |
|---|---|---|---|
| JP | 59-110990 | U | 7/1984 |
| JP | 63-83779 | U | 6/1988 |
| JP | 5-74526 | | 3/1993 |
| JP | 07-057825 | | 3/1995 |
| JP | 8-148222 | A | 6/1996 |
| JP | 08-306446 | | 11/1996 |
| JP | 9-7709 | | 1/1997 |
| JP | 2000-251024 | | 9/2000 |
| JP | 2000-251025 | | 9/2000 |
| JP | 2002-270261 | A | 9/2002 |
| JP | 2002-352885 | | 12/2002 |
| JP | 03-425696 | | 5/2003 |
| JP | 3451393 | | 7/2003 |

OTHER PUBLICATIONS

Co-Pending U.S. Appl. No. 10/954,491; Title: Connector for Flexible Printed Circuit Board; U.S. Filing Date: Oct. 1, 2004.

Co-Pending U.S. Appl. No. 11/480,830; U.S. Filing Date: Jul. 6, 2006.

Co-Pending U.S. Appl. No. 11/516,561; U.S. Filing Date: Sep. 7, 2006.

Office Action in co-pending U.S. Appl. No. 10/400,678, filed Jun. 10, 2004.

Office Action in co-pending U.S. Appl. No. 10/464,538, filed Jun. 8, 2004.

Office Action in co-pending U.S. Appl. No. 10/954,491, filed Jan. 24, 2006.

Office Action in co-pending U.S. Appl. No. 10/954,491, filed Sep. 2, 2005.

Office Action in co-pending U.S. Appl. No. 11/480,830, filed Nov. 6, 2006.

Office Action in co-pending U.S. Appl. No. 10/954,491, filed Feb. 23, 2007.

Office Action in co-pending U.S. Appl. No. 11/480,830, filed Mar. 30, 2007.

* cited by examiner

PLUG CONNECTOR

This application claims the benefit of Japanese Patent Application Nos. 2005-313054, filed Oct. 27, 2005 and 2006-238081, filed Sep. 1, 2006, which are hereby incorporated by reference herein in their entirety.

BACKGROUND OF THE INVENTION

1. Field of the Invention

The present invention relates to plug connectors, and more particularly to a plug connector for connecting a printed wiring board to a card-edge connector.

2. Description of the Related Art

It is a conventional practice to provide a printed wiring board with an electrical connection by directly inserting it to a card-edge connector arranged on a motherboard, etc., as disclosed in Japanese Patent Application Laid-open No. 5-074526 (1993). The printed wiring board has a connector-contact arrangement where contact electrodes (hereinafter, referred to as "pads") are provided as external terminals on the main and back surface thereof so that it can be clamped between a pair of elastically-deformable contact electrodes provided on the card-edge-connector side. This places the pads arranged on the main and back surfaces into electrical connection with the corresponding contact electrodes of the card-edge connector.

In the meanwhile, signal exchanges increases between the printed wiring board and the motherboard, etc. with the increase of processing functions, the number of pads increases on the printed wiring board. Consequently, where the number of pads increases, the distance between the adjacent pads, i.e. pitch, is limitedly reduced, thus resulting in a connector-contact arrangement not narrowed for the printed wiring board. However, the connector-contact arrangement of the printed wiring board has a width regulated related to the card-edge connector, and hence cannot be broadened unlimitedly.

In order to cope with the increasing pads, it is possible to contemplate a connection scheme that a plurality of levels of connector-contact arrangements are vertically provided for one printed wiring board so that those can be inserted to a plurality of card-edge connectors, as shown in FIG. 16, for example.

In FIG. 16, reference numerals 510, 520, 530 . . . are printed wiring boards. In FIG. 16, first and second printed wiring boards 510, 520 have vertical two levels of connector contact regions 511, 512 and 521, 522, respectively. A third printed wiring board 530 is of the usual type having one connector-contact arrangement integrally. Reference numeral 600 refers to a card-edge connector group provided on the side of a motherboard or the like, which has a plurality of card-edge connectors 611, 612, 621, 622, 631 . . .

In the first printed wiring board 510, of the two connector-contact arrangements, the first connector-contact arrangement 511 arranged lower in level is formed integral with the first printed wiring board 510. Meanwhile, the second connector-contact arrangement 512 arranged upper in level is connected with the first printed wiring board 510 via a connector 515. The first printed wiring board 510 is to be electrically connected with a mother board or the like by simultaneously inserting its two connector-contact arrangements 511, 512 to the corresponding card-edge connectors 611, 612, respectively. The second printed wiring board 520 also has a second connector-contact arrangement 522 being connected with the second printed wiring board 520 via the first connector-contact arrangement 521 and connector 525 formed integral with the second printed wiring board 520, similarly to the first printed wiring board 510.

FIG. 16 shows the printed wiring board arranged with the connector-contact arrangements in two levels. However, for certain number of pads, it can be contemplated to insert a multiple levels of connector-contact arrangements to the corresponding card-edge connectors in the case where three levels or more of connector-contact arrangements are arranged for one printed wiring board or in the case where a plurality of printed wiring boards each having a plurality of connector-contact arrangements including one level are combined.

When inserting the connector-contact arrangement to the card-edge connector, the connector-contact arrangement is required to first abuts against a pair of elastically-deformable contact electrode of the card-edge connector and to thereby deform those. For this reason, the connector-contact arrangement is chamfered at its front end thus being structured to reduce the resistance in deforming the contact electrodes of the card-edge connector. However, the printed wiring board is made of epoxy resin in its insulating region. By chamfering the printed wiring board after fabrication, resins or glass fibers are surfaced out. Therefore, the surface chamfered is rough and high in frictional coefficient.

FIG. 17 shows a change in the inserting force, at line (a), required to insert a printed wiring board having one connector-contact arrangement as in the third printed wiring board 530 shown in FIG. 16. As shown by the line (a) in FIG. 17, the inserting force gradually increases as the elastically-deformable contacts of the card-edge connector opens along the slant surfaces of the printed wiring board. Then, the inserting force attains its peak immediately before the contacts reach the upper and lower surfaces of the printed wiring board. Once the contacts reach the upper and lower surfaces of the printed wiring board, the inserting force becomes nearly constant. In this case, the inserting force at the peak is 60 N (approximately 6 kgf). It can be therefore known that at least 60 N of force is required for insertion.

Where simultaneously inserting a plurality of (four, assumed in the figure) levels of connector-contact arrangements to the card-edge connectors, 240 N (approximately 24 kgf) is required as shown at line (b) in FIG. 17. Taking account of a limit of 120 N (approximately 12 kgf) in manual insertion, there is a difficulty in manually inserting the printed wiring board directly to the card-edge connectors. Thus, it can be understood that trouble is possibly encountered in exchanging the printed wiring board.

In order to reduce the inserting force, it can be considered to arrange a plurality of levels of connector-contact arrangements with longitudinal deviations with respect to the inserting direction. With small amount of deviations, nothing is different from simultaneous insertion thus obtaining no or less effect. Conversely, with greater deviations, the connector-contact arrangement or card-edge connector undesirably increases in length. Furthermore, there is a possibility that a plurality of levels of connector-contact arrangements rotate about the front end of the connector-contact arrangement first inserted, resulting in a difficulty in inserting the remaining connector-contact arrangements to the card-edge connectors or in a state similar to that of simultaneous insertion.

Meanwhile, in the connector-contact arrangement, because pads are arranged on the main and back surfaces of the printed wiring board, there is a problem of crosstalk that, when signals are transmitted at high rate, signal leak occurs at between the signal lines connected to the pads.

It is an object of the present invention to provide a plug connector whose inserting force to a card-edge connector required to electrically connect a printed wiring board to a card-edge connector is reduced and which prevents the crosstalk between the signal lines.

SUMMARY OF THE INVENTION

In order to achieve the object, a plug connector of the invention, for electrically connecting a printed wiring board with a card-edge connector, comprises a first connector-contact arrangement that is inserted to a card-edge connector and that includes a first blade with a front surface having a recessed surface partly recessed therefrom and a plurality of first contact components arranged parallel one with another in the first blade, a second connector-contact arrangement that is inserted to a card-edge connector and that includes a second blade with a front surface having a recessed surface partly recessed therefrom and a plurality of second contact components arranged parallel one with another in the second blade. When the plug connector is formed by assembling the first and second connector-contact arrangements together, the first connector-contact arrangement is electrically connected with one printed wiring board through press-contact or push-contact while the second connector-contact arrangement is electrically connected therewith through clamp-contact.

Meanwhile, in the plug connector of the invention, it is preferable that, in the front-end surface of the first blade, the width of the front-end surface in which the recessed surface is not formed and that of the recessed surface are configured such that the number of the contact components corresponding to the front-end surface in which the recessed surface is not formed and the number of the contact components corresponding to the recessed surface are equal to each other.

Furthermore, in the plug connector of the invention, it is preferable that a cavity is formed between the conductors arranged in the upper and lower surfaces of the first blade of the first connector-contact arrangement a cavity is similarly formed between the conductors arranged upper and lower surfaces of the second blade of the second connector-contact arrangement.

Meanwhile, in the plug connector of the invention, two of the first connector-contact arrangements may structurally be oppositely arranged in a manner sandwiching one of the printed wiring board and one of the second connector-contact arrangement, thus having contact arrangement in three levels. Otherwise, one of the first connector-contact arrangement may be arranged over one of the printed wiring board and one of the second connector-contact arrangement to thereby forming a plug connector having contact arrangement in two levels, two of the plug connectors being connected vertically through a connecting member thus having contact arrangements in four levels.

In the plug connector of the invention, recessed surfaces are formed in both the blade front-end surfaces of the first and second connector-contact arrangements. Even where simultaneously inserting a plurality of levels of connector-contact arrangements to a card-edge connector, insertion is easy to perform with a small force. Furthermore, smooth insertion is expected because of the slant surfaces formed along the upper and lower sides of the front-end and recessed surfaces of the blade. As a result, this makes it easy to exchange the printed wiring board.

Meanwhile, in the plug connector of the invention, one connector-contact arrangement is electrically connected with a printed wiring board through press-contact while another connector-contact arrangement is electrically connected with a printed wiring board through clamp-contact. This makes it possible to efficiently arrange a plurality of levels of connector-contact arrangements. As a result, this requires a less number of assembling parts, thus obtaining a compact plug connector.

Furthermore, in the plug connector of the invention, by providing a cavity between the conductors serving as signal lines arranged in the upper and lower, crosstalk can be suppressed from occurring at between signal lines.

Further features of the present invention will become apparent from the following description of exemplary embodiments (with reference to the attached drawings).

DESCRIPTION OF THE EMBODIMENTS

Embodiments of the invention will now be described with using the drawings.

First Embodiment

Figure 1:
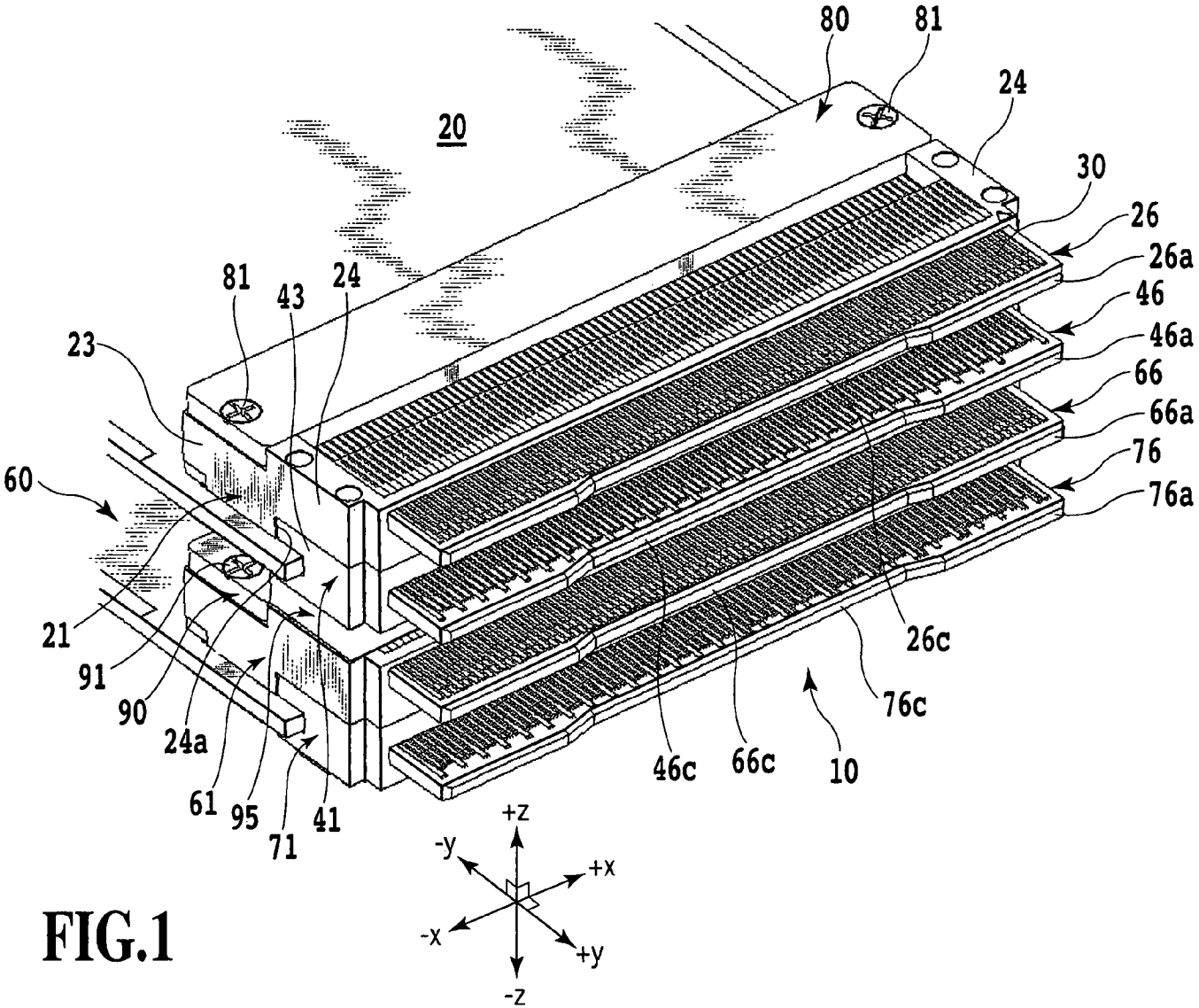
FIG. 1 is a schematic perspective view of a plug connector according to a first embodiment of the invention.
Figure 2:
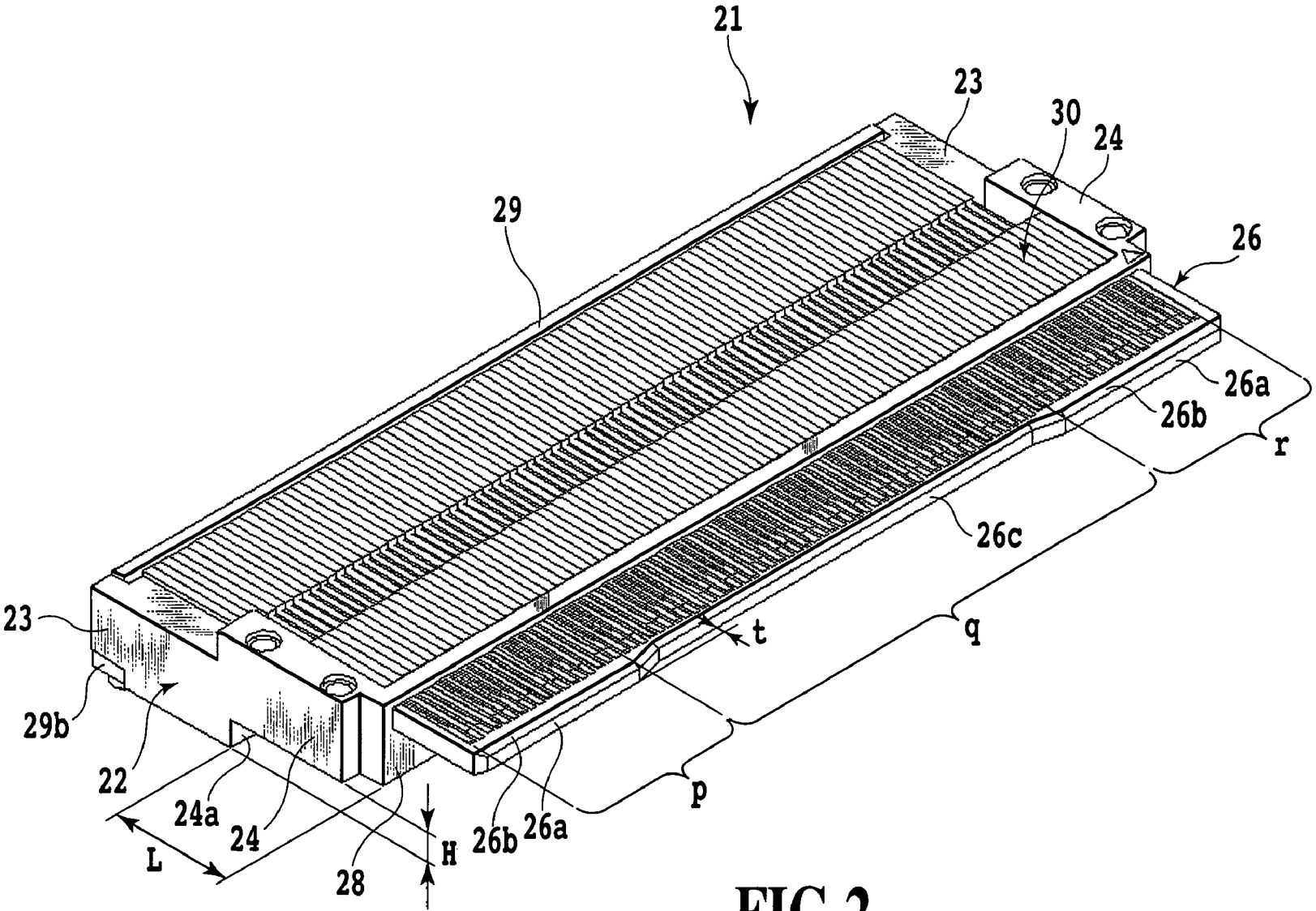
FIG. 2 is a schematic perspective view of a first connector-contact arrangement for structuring the FIG. 1 plug connector.
Figure 3:
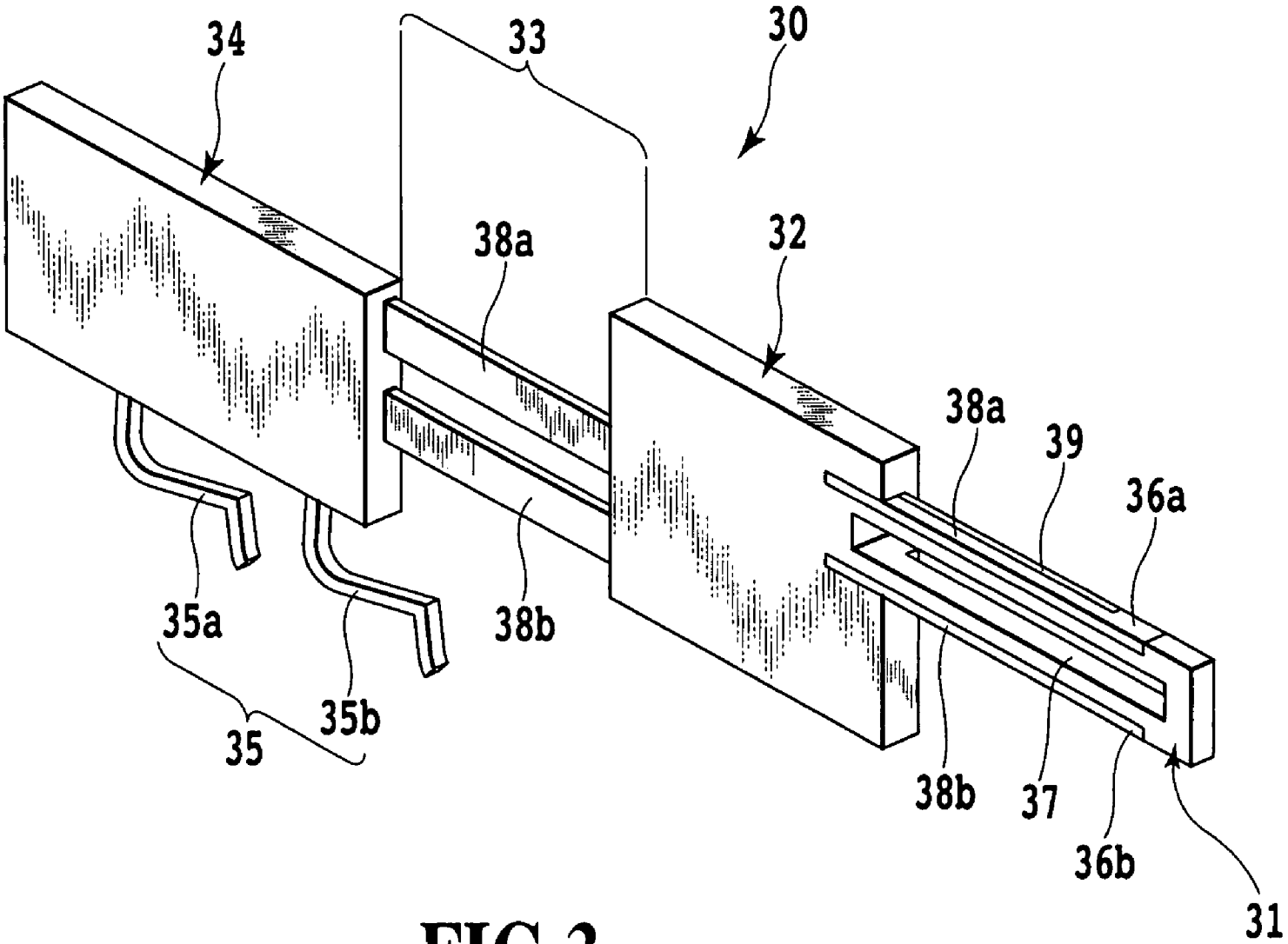
FIG. 3 is a schematic perspective view of a contact component for structuring the FIG. 2 first connector-contact arrangement.
Figure 4:
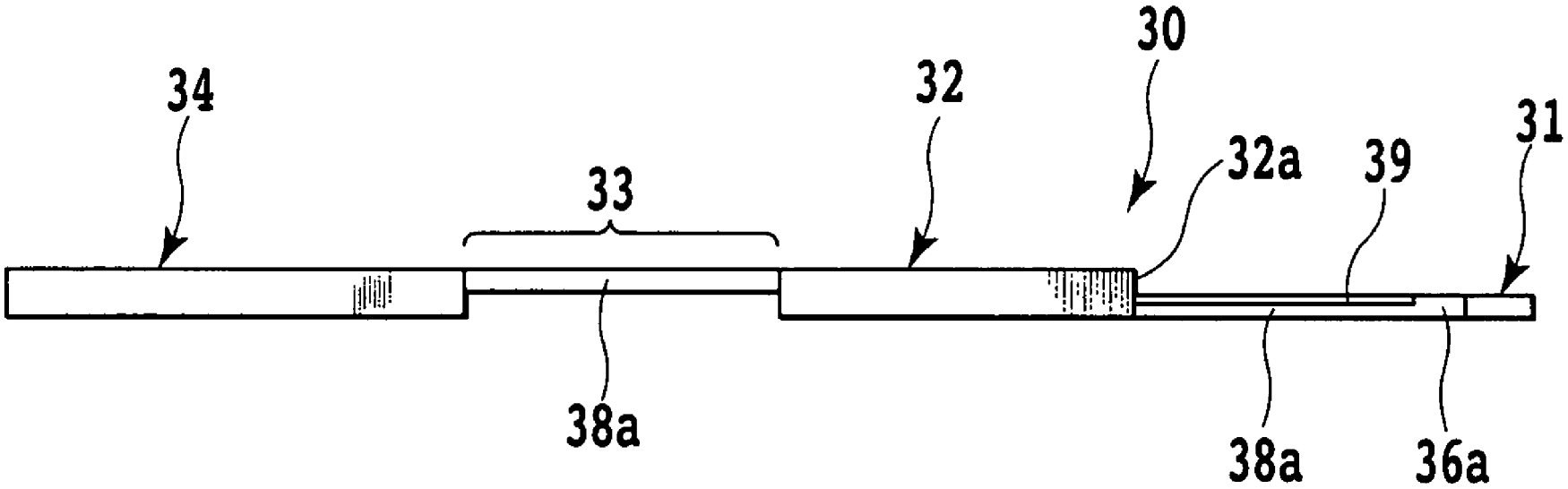
FIG. 4 is a schematic top view of the FIG. 3 contact component.
Figure 5:
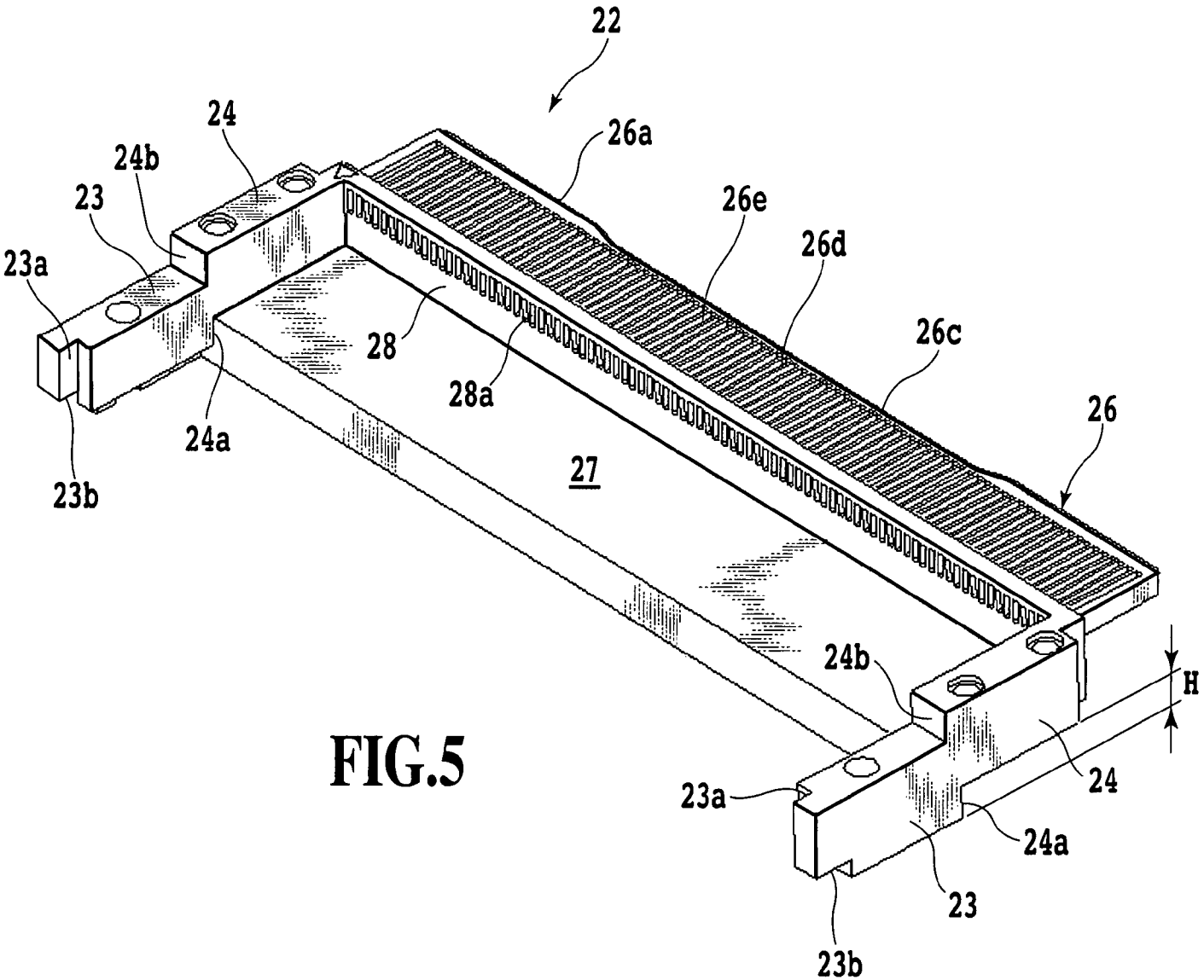
FIG. 5 is a schematic perspective view of a frame for structuring the FIG. 2 first connector-contact arrangement.
Figure 6:
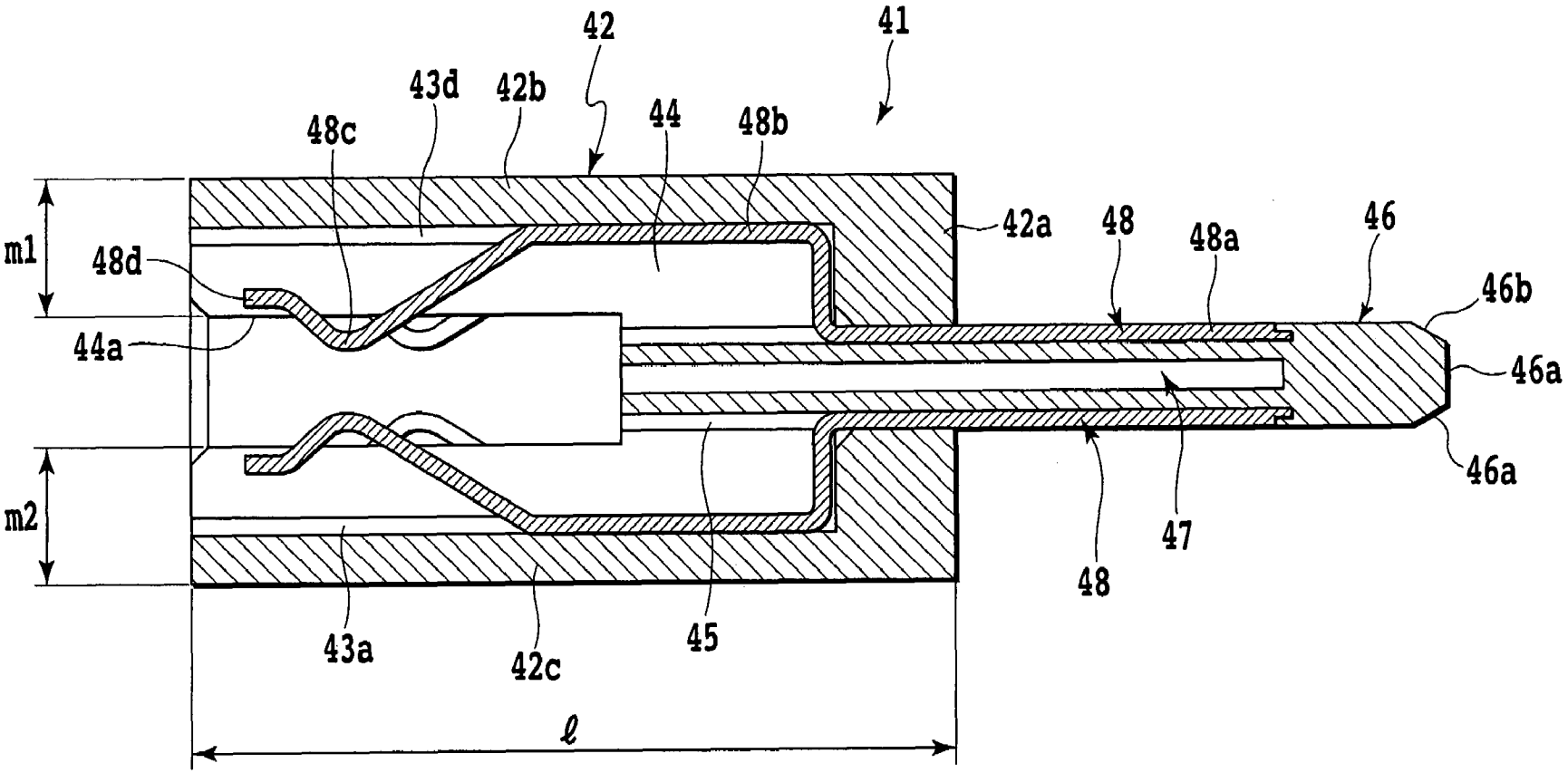
FIG. 6 is a schematic sectional view of a second connector-contact arrangement for structuring the FIG. 1 plug connector.

FIGS. 1 to 6 show a first embodiment according to the invention. FIG. 1 is a schematic perspective view of a plug connector according to the first embodiment. FIG. 2 is a schematic perspective view of a first connector-contact arrangement for structuring the FIG. 1 plug connector. FIG. 3 is a schematic perspective view of a contact component for structuring the FIG. 2 first connector-contact arrangement. FIG. 4 is a top view of the FIG. 3 contact component. FIG. 5 is a schematic perspective view of a frame for structuring the FIG. 2 first connector-contact arrangement. FIG. 6 is a schematic sectional view of a second connector-contact arrangement for structuring the FIG. 1 plug connector.

Note that, in the description, "left" and "right" are respectively in directions of +x and −x in FIG. 1, "front" and "rear" are respectively in directions of +y and −y, and "upper" and "lower" are respectively in directions of +z and −z.

There is illustrated in FIG. 1 the overview of a plug connector 10 according to the first embodiment. As shown in FIG. 1, the plug connector 10 includes a first printed wiring board 20 and a second printed wiring board 60. For the first printed wiring board 20, provided are first and second connector-contact arrangements 21, 41 at the front end thereof. The first and second connector-contact arrangements 21, 41 are to be inserted in a card-edge connector (not shown) of a motherboard (not shown) so that the first printed wiring board 20 can be placed in electrical connection with the motherboard.

As shown in FIG. 1, the first connector-contact arrangement 21 is arranged on the first printed wiring board 20 while the second connector-contact arrangement 41 is arranged at a front end of the first printed wiring board 20. The first printed wiring board 20 and the first and second connector-contact arrangements 21, 41 are assembled into one body by use of screws 81, together with an upper fixing portion 80 arranged on a rear portion of the first connector-contact arrangement 21 and a lower fixing portion (not shown) arranged beneath a rear portion of the second connector-contact arrangement 41, thus constituting a plug connector having connector-contact arrangements in two levels.

Likewise, for the second printed wiring board 60, provided are third and fourth connector-contact arrangements 61, 71 at the front end thereof. The second printed wiring board 60 and the third and fourth connector-contact arrangements 61, 71 are assembled into one body by use of screws 91, together with an upper fixing portion 90 and a lower fixing portion (not shown), thus constituting a plug connector having connector-contact arrangements in two levels.

In this embodiment, the assembly of the first printed wiring board 20 and the first and second connector-contact arrangements 21, 41 and the assembly of the second printed wiring board 60 and the third and fourth connector-contact arrangements 61, 71, are further assembled into one body through a connecting member 95. As a result, the plug connector in this embodiment constitutes a plug connector 10 having connector-contact arrangements in four levels. In this manner, the connector-contact arrangements are efficiently arranged in building the plug connector 10, which makes assembling easy to perform and requires the reduced number of assembling components. Incidentally, the first, second, third and fourth connector-contact arrangements 21, 41, 61, 71, constituting the plug connector 10 thus built, have respective front walls positioned in flush one with another (i.e. existing on the common plane).

There is schematically shown, in FIG. 2, the first connector-contact arrangement 21 for the first printed wiring board 20. The first connector-contact arrangement 21 roughly includes a frame 22 and a plurality of first contact components 30.

The frame 22 receives therein a plurality of the first contact components 30 as shown in, FIG. 2, thus constituting a first connector-contact arrangement 21. As clearly shown in FIG. 5, the frame 22 roughly includes first sidewalls 23, 23 in the right-and-left second sidewalls 24, 24 in the right-and-left respectively continuing frontward from the first sidewalls 23, 23, a front wall 28 connecting between the front ends of the right-and-left second sidewalls 24, 24, a first blade 26 protruding frontward from a front surface of the front wall 28, and a bottom wall 27 connecting between the lower ends of the right-and-left second sidewalls 24, 24. The right-and-left first sidewalls 23, 23, right-and-left second sidewalls 24, 24, the front wall 28, the first blade 26 and the bottom wall 27 are formed in one body of an insulating synthetic resin material.

The right-and-left first sidewalls 23, 23 are vertically opened at between those, to arrange a plurality of second fixing portions 34 of first contact components 30 in parallel one with another. The right-and-left first sidewalls 23, 23 are formed with vertical cutouts 23*a*, 23*a* and horizontal cutouts 23*b*, 23*b* in rear portions thereof, in order to attach a rear wall 29 thereon. The rear wall 29 is formed, at lower right-and-left with protrusions 29*b*, 29*b* to be buried in the horizontal cutouts 23*b*, 23*b*, thus being fixed between the vertical cutouts 23*a*, 23*a* provided rear in the right-and-left first sidewalls 23, 23 as shown in FIG. 2.

The right-and-left second sidewalls 24, 24 are respectively positioned upper relative to the right-and-left first sidewalls 23, 23 as clearly shown in FIG. 5, thus forming upper steps 24*b*, 24*b* and lower steps 24*a*, 24*a* between the first and second sidewalls 23, 24. The lower steps 24*a* and the lower surfaces of the second sidewalls 24 form a space in a size to receive the upper half of the second connector-contact arrangement 41, referred later. The right-and-left second sidewalls 24, 24, the bottom wall 27 and the front wall 28 form a space opened to the upper and lower, to arrange therein a plurality of first fixing portions 32 of the first contact components 30, referred later, parallel one with another.

The front wall 28 extends closing the front end of between the right-and-left second sidewalls 24, 24, in the upper region of which a plurality of through-holes 28*a* are formed extending longitudinally and parallel one with another. The through-holes 28*a* communicate the space, formed by the right-and-left second sidewalls 24, 24, the bottom wall 27 and the front wall 28, with the slits 26*e* in a first blade 26, referred later.

The first blade 26 is structured with a portion to be inserted to a card-edge connector. The first blade 26 protrudes frontward from and perpendicularly relative to the front wall 28 as noted before, thus assuming nearly a flat-plate form in its outer shape. The first blade 26 has a front surface 26*a* formed with slant faces 26*b* along the upper and lower sides thereof. The first blade 26 is formed of a synthetic resin including the slant faces 26*b*. Incidentally, the slant faces 26*b* may be formed by chamfering after being molded. Due to this, when inserting the first connector-contact arrangement 21 to a card-edge connector, the resistance to the first blade 26 is reduced as compared to the case to directly insert a connector-contact arrangement of the existing printed wiring board. This makes it possible to smoothly insert connector-contact arrangements in plurality of levels to a card-edge connector. In this embodiment, the first blade 26 was formed with the slant faces 26*b* along the upper and lower sides in the front surface 26*a* thereof. This, however, is not limitative. For example, the front surface 26*a* may be rounded in section, as shown in a third embodiment to be referred later (see FIGS. 9 to 13).

The first blade 26 is also formed with a plurality of slits 26*e*, that are opened vertically and long longitudinally, in parallel one with another. The slits 26*e* communicate with the through-holes 28*a* formed through the front wall 28. In a space formed by the slit 26*e* and the through-hole 28*a*, arranged is a projection piece 31 of a contact component 30, referred later. Incidentally, reference numeral 26*d* represents partition walls between the slits 26*e*.

In the front surface 26*a* of the first blade 26, a recessed surface 26*c* is further formed by recessing a part of the front surface by a dimension t parallel therewith, as clearly shown in FIG. 2. In this embodiment, the recessed surface 26*c* is formed nearly centrally of the front surface 26*a* of the first blade 26 extending in a left-right direction. This embodiment provided it centrally of the front surface 26*a*. This, however, is not limitative. For example, the recessed surface 26 may be separated in the right-and-left direction. In this case, the front surface 26*a* in portions not recessed also is naturally separated in structure.

Meanwhile, the dimension t, of between the front surface 26*a* and the recessed surface 26*c*, is preferably provided at approximately 0.6-1.6 mm. If the dimension is excessively small, no difference is obtainable from the case with no recessed surface 26*c*. If provided excessively great, the plug connector 10 is increased in size while insertion amount is not decreased. Incidentally, provided that the contact components 30 corresponding to the recessed surface 26*c* are in the number of q while the contact components corresponding to front-end surface 26*a* not recessed, i.e. the front-end surface 26*a* in a portion not formed as the recessed surface 26*c*, are in the number of p and r in the FIG. 2 case, the recessed surface 26*c* is most preferably established with such a length in a right-and-left direction (the sum of divisional lengths where the recessed surface 26*c* is divided) as q=p+r. However, this is not limitative, i.e. q is not preferably different excessively from (p+r) but may be somewhat smaller or greater than (p+r). It can be understood that, by providing such a structure, inserting the first connector-contact arrangement 21 to a card-edge connector requires a force nearly a half as compared to the case no recessed surface 26*c* is provided.

Figure 8:
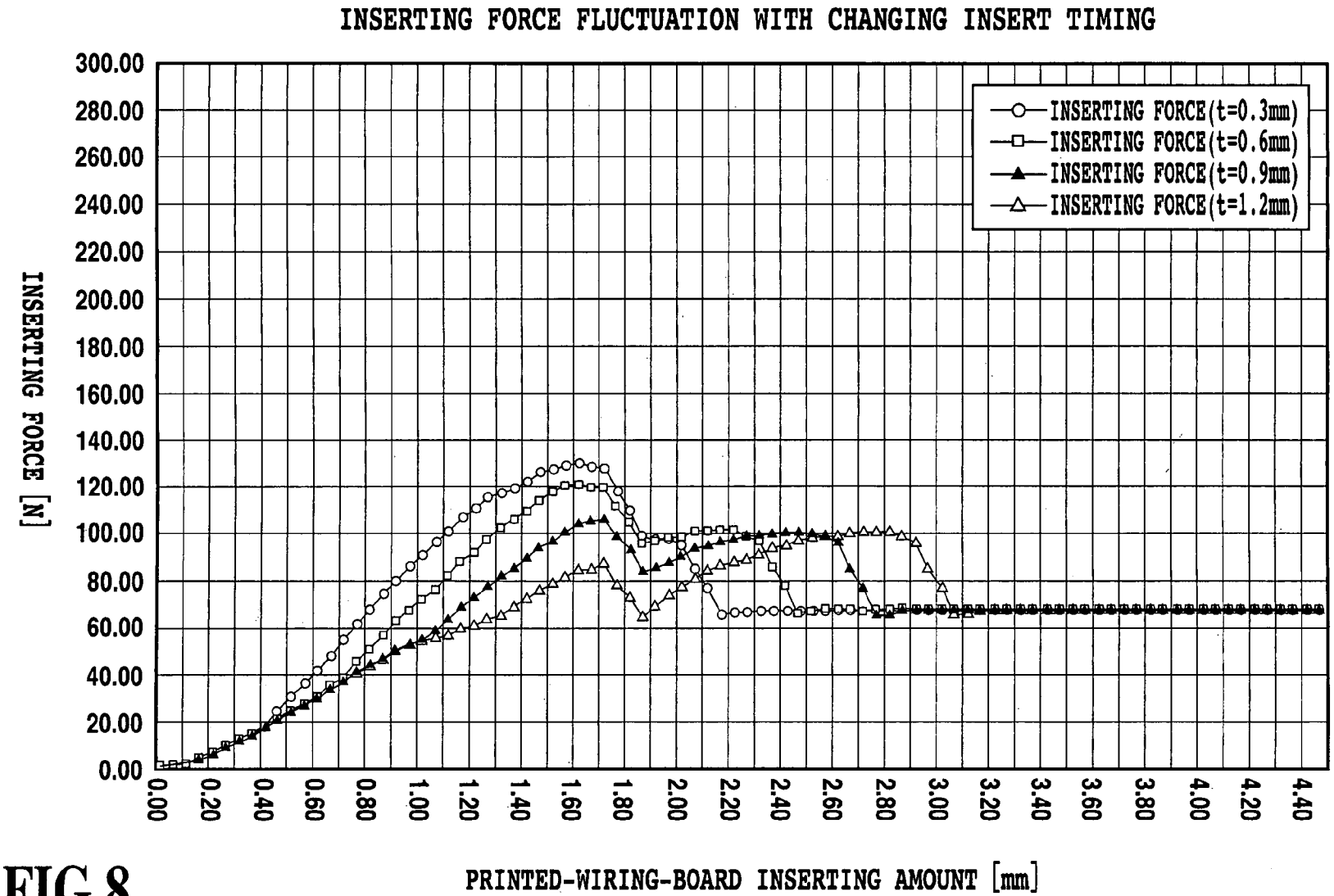
FIG. 8 is a graph showing a change of the total inserting force with a change in the dimension of the front-end and recessed surfaces of the blade, in a plug connector having four levels of connector-contact arrangement according to the embodiment of the invention.

In the plug connector 10 of the present embodiment, the first connector-contact arrangement 21 is formed in one body of a synthetic resin wherein a recessed surface is formed in the front surface 26*a* of the first blade 26. Accordingly, inserting force is reduced as shown in the graph in FIG. 8, as compared to the case to insert a conventional connector-contact arrangement of a printed wiring board directly to a card-edge connector.

Description is now made on the first contact component 30 to be arranged in the frame 22. The first contact component 30 is shown in detail in FIGS. 3 and 4.

The first contact component 30 roughly includes a plate-like projection piece 31, a first fixing portion 32, a non-fixing portion 33, a second fixing portion 34, a printed-wiring-board contact portion 35 and conductors 38*a*, 38*b* serving as two signal lines. The first contact component 30 is formed in one body by insert-molding or so. Specifically, the first contact component 30 is integrally formed by insert-molding wherein molding is made by previously burying the conductors 38*a*, 38*b* in an electrically-insulating synthetic resin material.

The projection piece 31 is nearly in a plate-like outer shape, extending frontward along one side surface (right-side surface, in this embodiment) of the first fixing portion 32. The projection piece 31 has a thickness (right-to-left dimension) smaller than the thickness of the first fixing portion 32. Accordingly, a step 32*a* exists in the connection between the projection piece 31 and the first fixing portion 32 (see FIG. 4). The projection piece 31 has a length (longitudinal dimension) equal to the length of the slit 26*e* of the first blade 26 plus the length of the through-hole 28*a* of the front wall 28.

On the upper and lower surfaces of the projection piece 31, conductors 38*a*, 38*b* are respectively arranged as signal lines (lines for transmitting signals or for grounding). The conductors 38*a*, 38*b* extend longitudinally along the right-side surface of the projection piece 31. The conductors 38*a*, 38*b* have a front end formed with pads 36*a*, 36*b* provided as external terminal to be electrically connected to a card-edge connector. The conductor 38*a*, 38*b* has a width (right-to-left dimension) smaller than the thickness of the projection piece 31. Meanwhile, the pad 36*a*, 36*b* has a width equal to the thickness of the projection piece 31. Accordingly, in the left of the conductor 38*a*, 38*b*, a synthetic resin 39 exists structuring the projection piece 31 so that impedance can be regulated by the size (width and length) thereof.

As shown in FIG. 3, an elongate cavity 37 is formed extending longitudinally nearly centrally of the projection piece 31, at between the conductors 38*a*, 38*b* and pads 36*a*, 36*b* arranged in the upper and lower of the projection piece 31. By providing the cavity 37, a low dielectric constant of air is allowed to intervene between the two conductors 38*a*, 38*b* forming opposed signal lines. This reduces the electric coupling between the two conductors 38*a*, 38*b* provided as opposed signal lines, thus preventing a signal from leaking at between the conductors 38*a*, 38*b*, i.e. to suppress crosstalk.

Incidentally, in order to suppress the crosstalk between the adjacent first contact components 30, the two parallel first contact components 30 for transmitting signals, are preferably arranged in a manner being sandwiched by two first contact components 30 for grounding. Namely, it is preferable to arrange first contact components 30 for grounding every two first contact components 30 for transmitting signals. In this case, the cavity 37 may be omitted because the conductors 38*a*, 38*b* are for grounding that are insert-molded in the first contact component 30 for grounding. Meanwhile, the first contact component 30 for grounding naturally possesses the function to suppress the generation of noise.

The first fixing portion 32 is formed generally in a flat-plate form. In the first fixing portion 32, signal-line conductors 38*a*, 38*b* are buried and fixed in a flat plate formed of a synthetic resin material. The first fixing portion 32 is arranged between the second sidewalls 24, 24 of the frame 22, thereby fixing the first contact component 30 in the frame 22. The first fixing portion 32 is nearly equal in height (vertical dimension) to the second sidewall 24, 24, and greater in thickness (right-to-left dimension) than the projection piece 31 as noted before. The first fixing portion 32 has a length (longitudinal dimension), added with the length of the non-fixing portion 33 referred later, nearly equal to the length of the second sidewall 24, 24.

The non-fixing portion 33 refers to the region where the conductors 38*a*, 38*b* are exposed. For this reason, the non-fixing portion 33 is deformable so that, when the first contact component 30 is arranged in the frame 22, a misfit rightward/leftward resulting from a design error or, in certain cases, a misfit longitudinal can be rectified. In the non-fixing portion 33, the conductor 38*a*, 38*b* are arranged extending out of the first fixing portion 32 at lower right thereof and toward the second fixing portion 34, referred later, at the upper right thereof.

The second fixing portion 34 is nearly in a flat-plate form similarly to the first fixing portion 32 and buried with the conductors 38*a*, 38*b* in the flat-plate body. The second fixing portion 34 is arranged between the first sidewalls 23, 23 of the frame 22, to fix the first contact component 30 in the frame 22. The second fixing portion 34 has a length (longitudinal dimension) smaller by the thickness of the rear wall 29 than the first sidewall 23, 23, and a height (vertical dimension) smaller nearly by the height of the printed-wiring-board contact portion 35, referred later, than the first sidewall 23, 23. The second fixing portion 34 is nearly equal in width (right-to-left dimension) to the first fixing portion 32.

The print-wiring-board contact portion 35 is formed by two conductors 38*a*, 38*b* projecting downward from the second fixing portion 34 and curved elastically deformable, the respective ones of which form contacts 35*a*, 35*b*. The contacts 35*a*, 35*b* are to be placed in contact with the corresponding external terminals of the printed wiring board 20. The contacts 35*a*, 35*b* are in a form to somewhat project from the bottom surface of the first sidewall 23, 23 when assembled in the frame 22. Accordingly, when assembled in the printed wiring board 20, the contacts 35, 35 are elastically deformed by being pushed onto the printed wiring board 20, thus placed in electric connection, under predetermined pressure, with the external terminals provided on one surface of the printed wiring board 20 (i.e. top surface of the printed wiring board 20, in this embodiment). Namely, the first connector-contact arrangement 21 in this embodiment is to be placed in electrical connection with the printed wiring board 20 by being forcibly pressed into contact with the printed wiring board 20.

Figure 14:
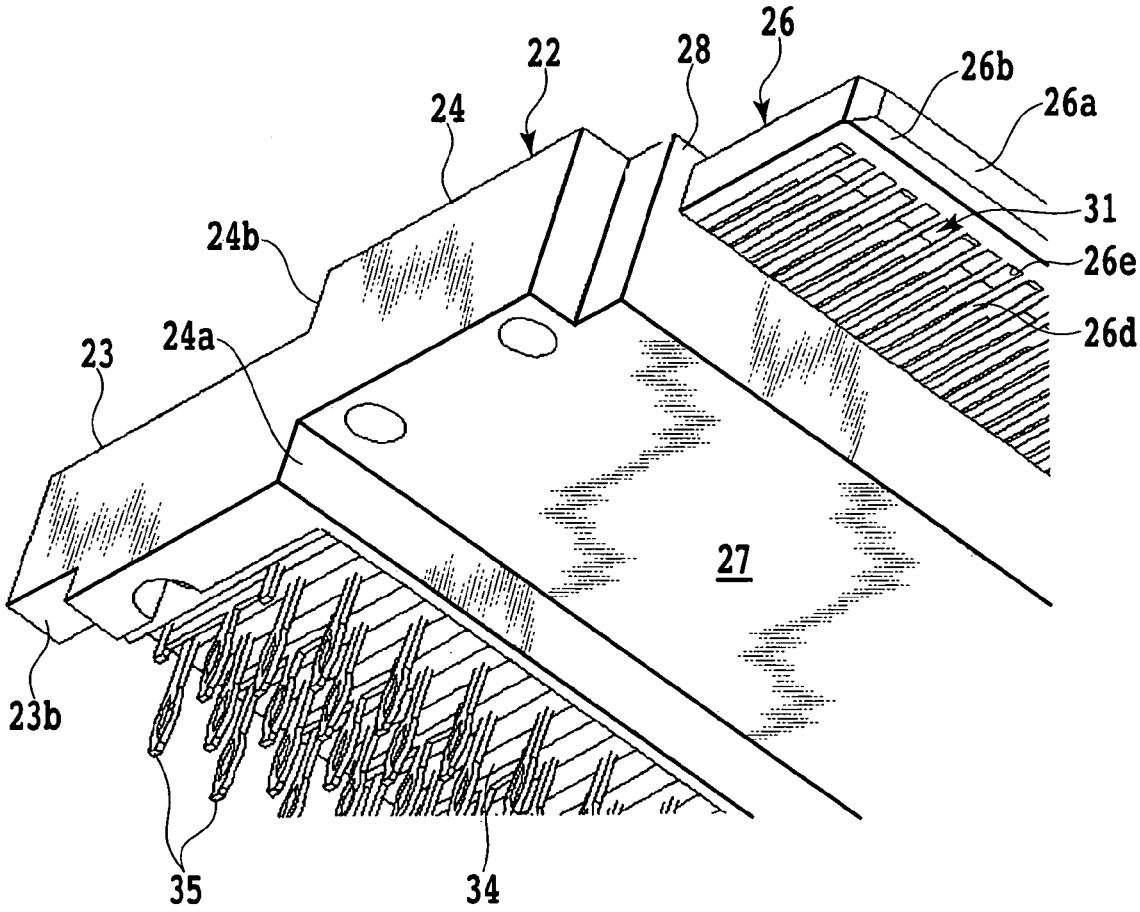
FIG. 14 is a schematic essential-part perspective view showing another printed-wiring-board contact region in the first contact component for the FIG. 2 connector-contact arrangement.
Figure 15:
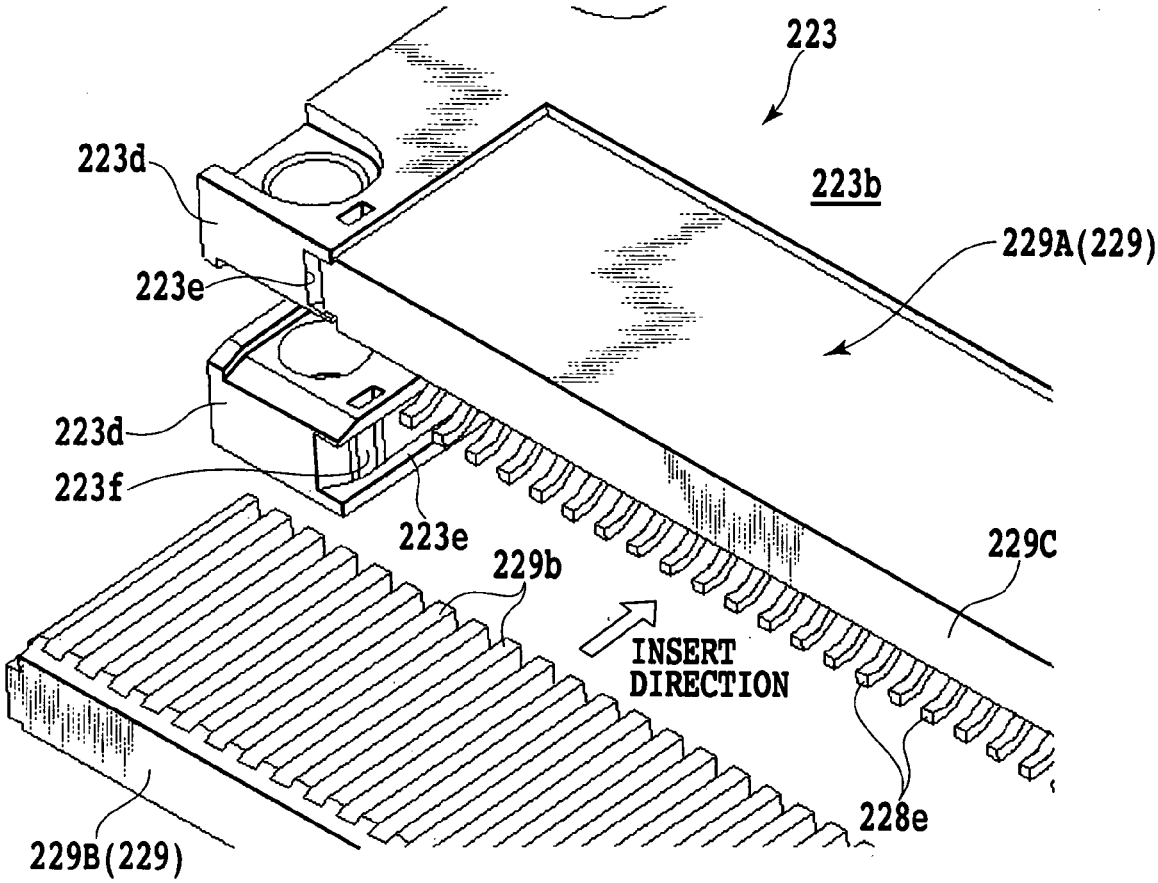
FIG. 15 is a schematic essential-part perspective view showing the mounting to a terminal member of a cover member structuring the FIG. 11 first connector-contact arrangement.
Figure 16:
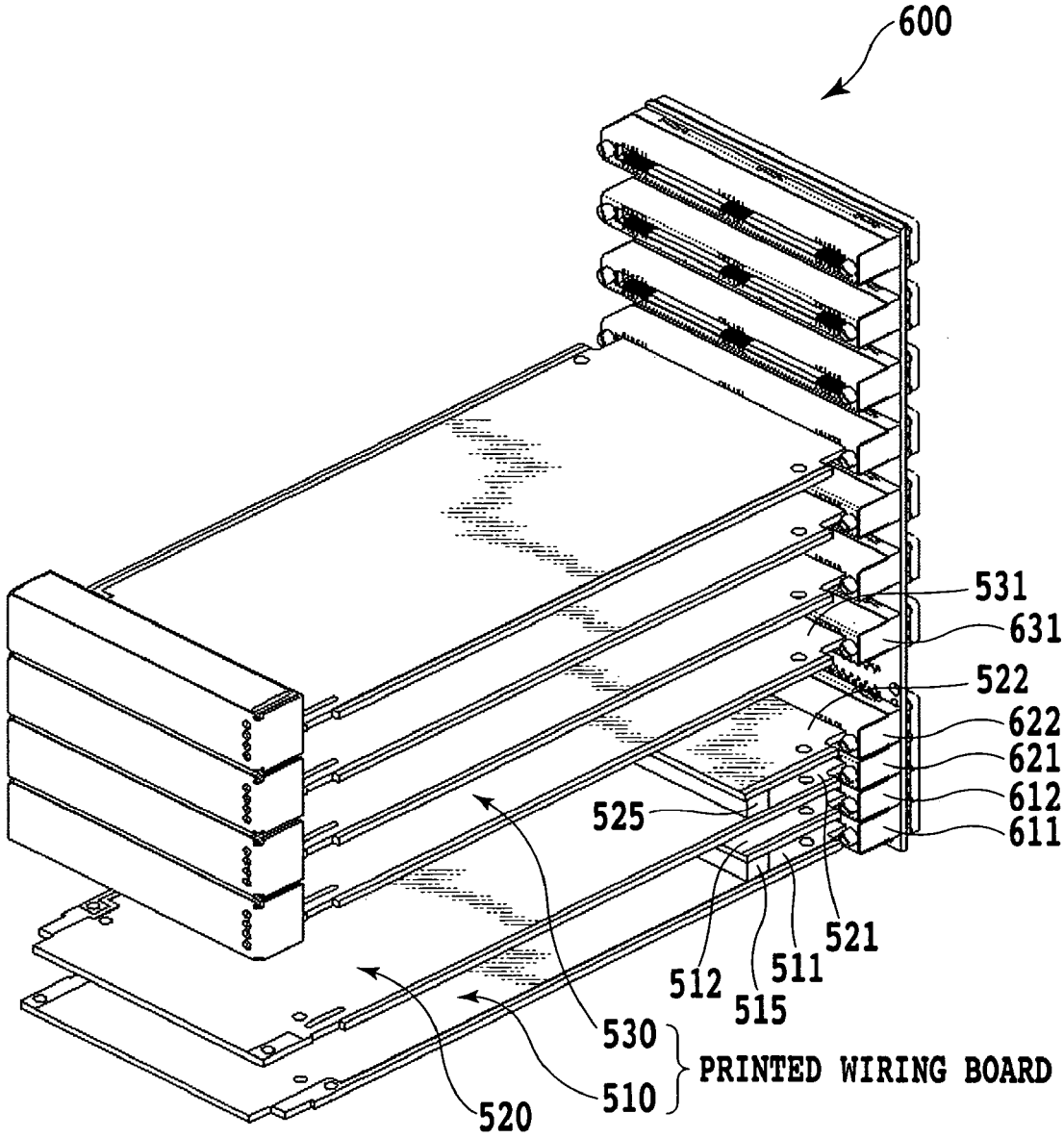
FIG. 16 is a schematic perspective view showing the connection of the existing printed wiring board to a card-edge connector.
Figure 17:
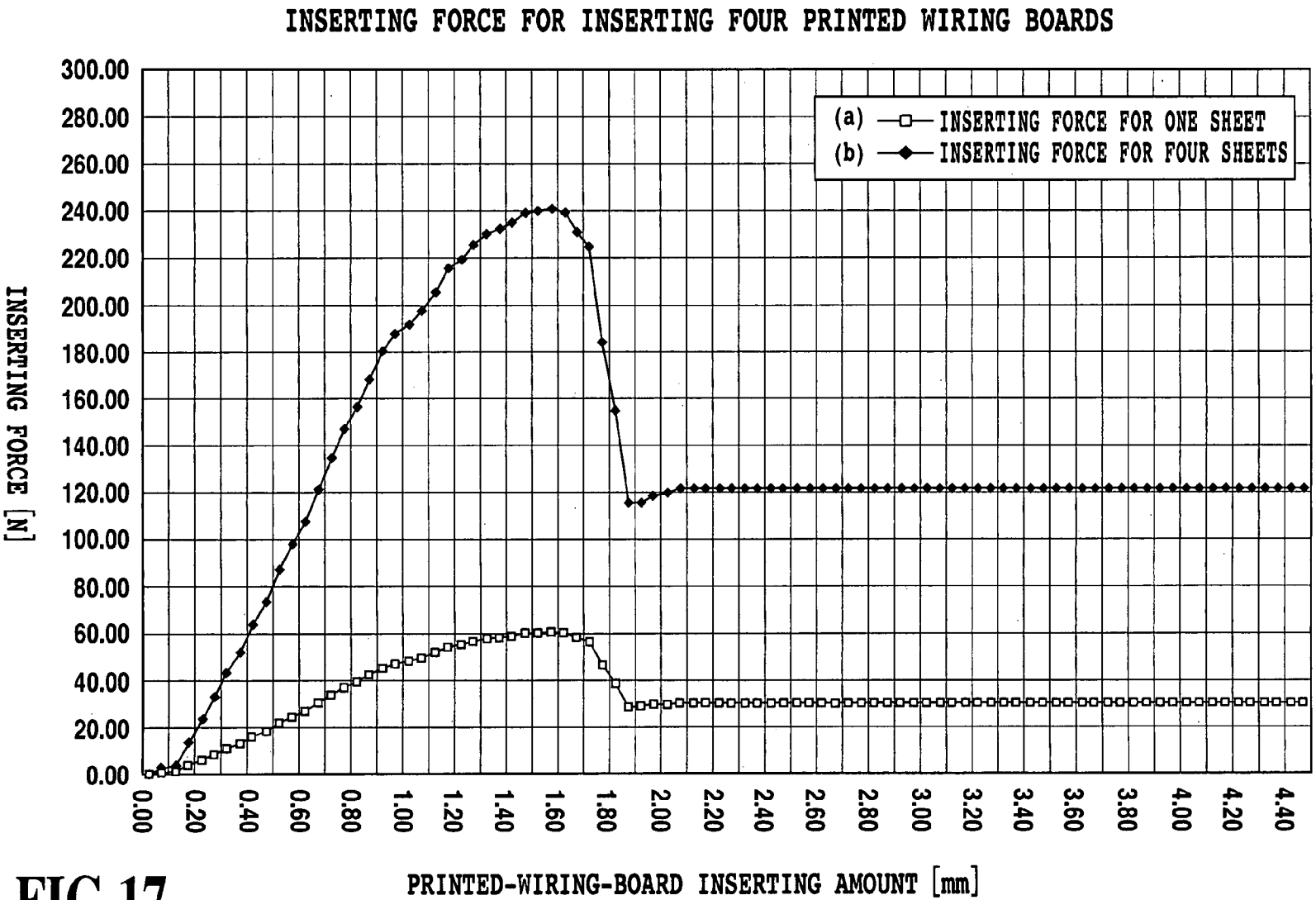
FIG. 17 is a graph showing a change of the inserting force in connecting the existing printed wiring board to a card-edge connector.

Incidentally, in this embodiment, the print-wiring-board contact portion 35, of the first contact component 30 structuring the first connector-contact arrangement 21, is forcibly pushed into contact with the external terminals of the printed wiring board 20. This, however, is not limitative. For example, the two conductors 38*a*, 38*b*, projecting downward from the second fixing portion 34, may be provided extending straight downward without being bent so that they can be pushed in or pressed in through-holes formed as external terminals on the printed wiring board 20, thus being placed in electrical connection (see FIG. 14). In this case, the first connector-contact arrangement 21 can be electrically connected with the printed wiring board 20 by being forcibly pushed into contact with the printed wiring board 20.

As shown in FIG. 2, the first contact component 30 is inserted in the frame 22 at from the rear of the frame 22 such that the projection pieces 31 of the first contact components 30 are fit into a plurality of slits 26*e* formed in the first blade 26 of the frame 22. After completing the arrangement of the first contact components 30, the rear wall 29 is fixed, thereby structuring a first connector-contact arrangement 21.

Description is now made on the second connector-contact arrangement 41. FIG. 6 shows a schematic sectional view of the second connector-contact arrangement 41.

As shown in FIG. 6, the second connector-contact arrangement 41 roughly includes a case 42 and a plurality of second contact components 48 pressed in the case 42.

The case 42 includes a front wall 42*a*, a top wall 42*b*, a bottom wall 42*c*, sidewalls 43, 43 in the right-and-left (see FIG. 1) and a second blade 46 nearly similar in form to the first blade 26 provided in the frame 22 of the first connector-contact arrangement 21. In the case 42, there is formed a space receiving therein the second contact components 48. The receiving space is opened to the rear, as shown in FIG. 6. The length 1, of from the rear open end of the case 42 to the front surface of the front wall 42*a*, is provided equal to the distance L of from the lower level 24*a* of the frame 22 structuring the first connector-contact arrangement 21 to the front surface of the front wall 28. Furthermore, the dimensions (heights) m1, m2, of from a cutout 44*a* formed in the sidewall 43 to the upper surface of the top wall 42*b* and to the lower surface of the bottom wall 42*c*, are provided equal to the height H of the lower level 24*a* of the frame 22 structuring the first connector-contact arrangement 21. With this structure, when the first and second connector-contact arrangements 21, 41 are assembled together, the front walls 28, 42*a* of the connector-contact arrangements 21, 41 are in flush at their front surfaces. This ultimately places, on the each common plane, the front surface 26*a* and the front surface 46*a*, and recessed surface 26*c* of the first blade 26 structuring the first connector-contact arrangement 21 and recessed surface 46*c* of the second blade 46 structuring the second connector-contact arrangement 41, respectively.

A plurality of press-in grooves 43*a*, 43*d* are formed oppositely in the bottom wall 42*c* and the top wall 42*b* respectively, to press therein a plurality of second contact components 48.

Incidentally, in this embodiment, partition walls 44 are provided in the case 42 in positions between the adjacent ones of the second contact components 48. Alternatively, the partition walls 44 may be omitted. Meanwhile, reference numeral 44*a* refers to cutouts for guiding the printed wiring board 20 at its front end, which are formed in the partition walls 44 and the right-and-left sidewalls 43, 43.

The second blade 46 of the second connector-contact arrangement 41 is the same in outer shape as the first blade 26 of the first connector-contact arrangement 21 but is not provided with slits 26*e* for inserting the first contact component 31 therein. The second blade 46 of the second connector-contact arrangement 41 is formed projecting frontward from the vertically-central region of the front wall 42*a*. The projection amount of the second blade 46 from the front wall 42*a* is equal to the projection amount of the first blade 26 from the front wall 28. As shown in FIG. 6, the second blade 46 is formed, in its upper and lower surfaces, with a plurality of fixing groove 45 in which the plurality of second contact components 48 (correctly, card-edge-connector contact portion 48*a* of the second contact components 48) are to be respectively fit. The fixed grooves 45 are formed through the front wall 42*a*. Meanwhile, the fixing grooves 45 correspond to the press-in grooves 43*d*, 43*a* formed respectively in the top and bottom walls 42*b*, 42*c*.

The front surface 46*a* of the second blade 46 has slant surfaces 46*b*, 46*b* in its upper and lower sides and a recessed surface 46*c* (see FIG. 1), similarly to the first blade 26 of the first connector-contact arrangement 21. Naturally, the position of the recessed surface 46*c* and the recess amount thereof from the front surface 46*a* are equal to those of the first blade 26. Incidentally, in this embodiment, the front surface 46*a* of the second blade 46 has an outer shape (i.e. contour) given the same as the contour of the front surface 26*a* of the first blade 26. This, however, is not limitative. In brief, it is satisfactory that the first and second blades 26, 46 are nearly equal in respect of the dimension t between the front surface and the recessed surface and the length q of the recessed surface in the right-to-left direction. Meanwhile, in this embodiment, the second blade 46 extends toward the space receiving the second contact components 48 and up to the cutout 44*a*, as shown in FIG. 2. By such a structure, the printed wiring boards 20 at its front end goes into abutment against the rear-end surface of the second blade 46. Due to this, the rear-end surface of the second blade 46 serves as a stopper to restrict the insertion amount of the printed wiring board 20.

Between the fixing grooves 45 formed in the upper and lower surfaces of the second blade 46, there is further formed a cavity 47 opened rearward in order to suppress the cross talk occurring between the second contact components 48 that are signal lines fit in the fixing grooves 45, similarly to the first contact components 30.

The second contact components 48 are arranged in pair vertically within the receiving space of the case 42, as shown in FIG. 6. Accordingly, second contact components 48 are electrically connected with the external terminals provided in the upper and lower surfaces of the printed wiring board 20. Namely, the second connector-contact arrangement 41 in this embodiment is to be placed in electrical connection with the printed wiring board 20 through clamp contact. Furthermore, the pair of second contact components 48, 48 are arranged in plurality of pairs parallel one with another within the receiving space of the case 42. The second contact components 48 are also utilized as signal and grounding lines similarly to the first contact components 30.

The second contact components 48 are fit in the fixing and press-in grooves 45, 43*a*, 43*d* thus being fixed in the case 42. The second contact component 48, formed of metal, is a conductor including a contact portion 48*a* as an external contact to be electrically connected to a card-edge connector, a fixing portion 48*b* to be fit in the press-in groove 43*a*, 43*d*, an elastically-deformable contact portion 48*c* to be electrically contacted with the external terminal of the printed wiring board 20, and a rear end 48*d* opened from the contact portion 48*c* in order to easily receive the tip of the printed wiring board 20.

Figure 10:
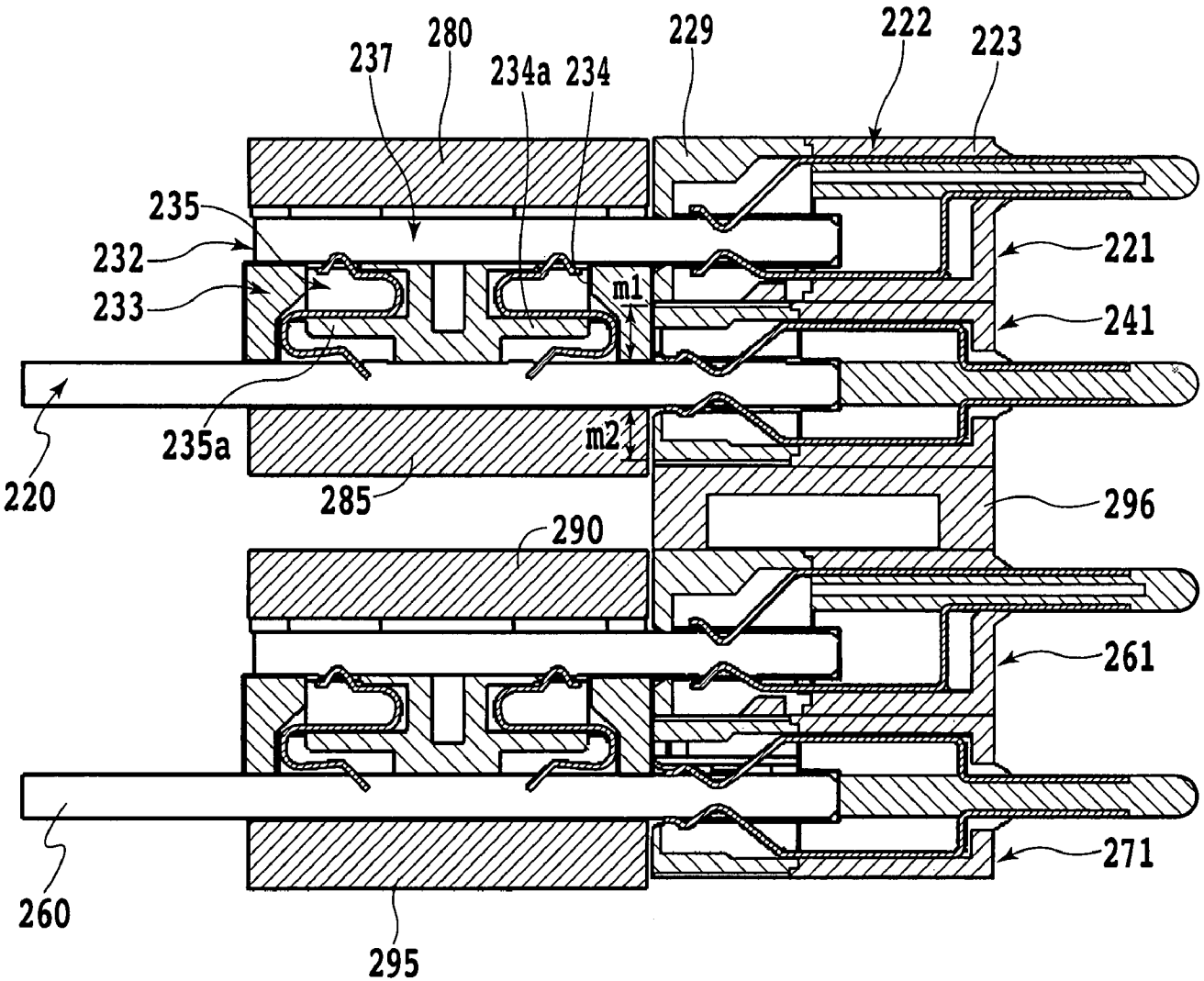
FIG. 10 is a schematic sectional view of the FIG. 9 plug connector.

The second connector-contact arrangement 41 has a structure to which the printed wiring board 20 is fit, similarly to the card-edge connector. However, the connection between the second connector-contact arrangement 41 and the printed wiring board 20 are not so frequent as the connection between the card-edge connector and the printed wiring board, i.e. after once connected, the connection is kept semi-permanent. Meanwhile, the inserting force per sheet, shown in FIG. 10, is sufficient to connect between the second connector-contact arrangement 41 and the printed wiring board 20.

Referring back to FIG. 1, the third and fourth connector-contact arrangements 61, 71 of the second printed wiring board 60 are respectively quite the same in form as the first and second connector-contact arrangements 21, 41 of the first printed wiring board 20, and hence are omitted to explain. Incidentally, in FIG. 1, reference numeral 66 refers to a third blade for the third connector-contact arrangements 61, reference numeral 66*a* to a front surface of the third blade 66, and reference numeral 66*c* to a recessed surface of the third blade 66. Similarly, reference numeral 76 refers to a fourth blade for the fourth connector-contact arrangements 71, 76*a* to a front surface of the fourth blade 76, and 76*c* to a recessed surface of the fourth blade 76.

Second Embodiment

Figure 7:
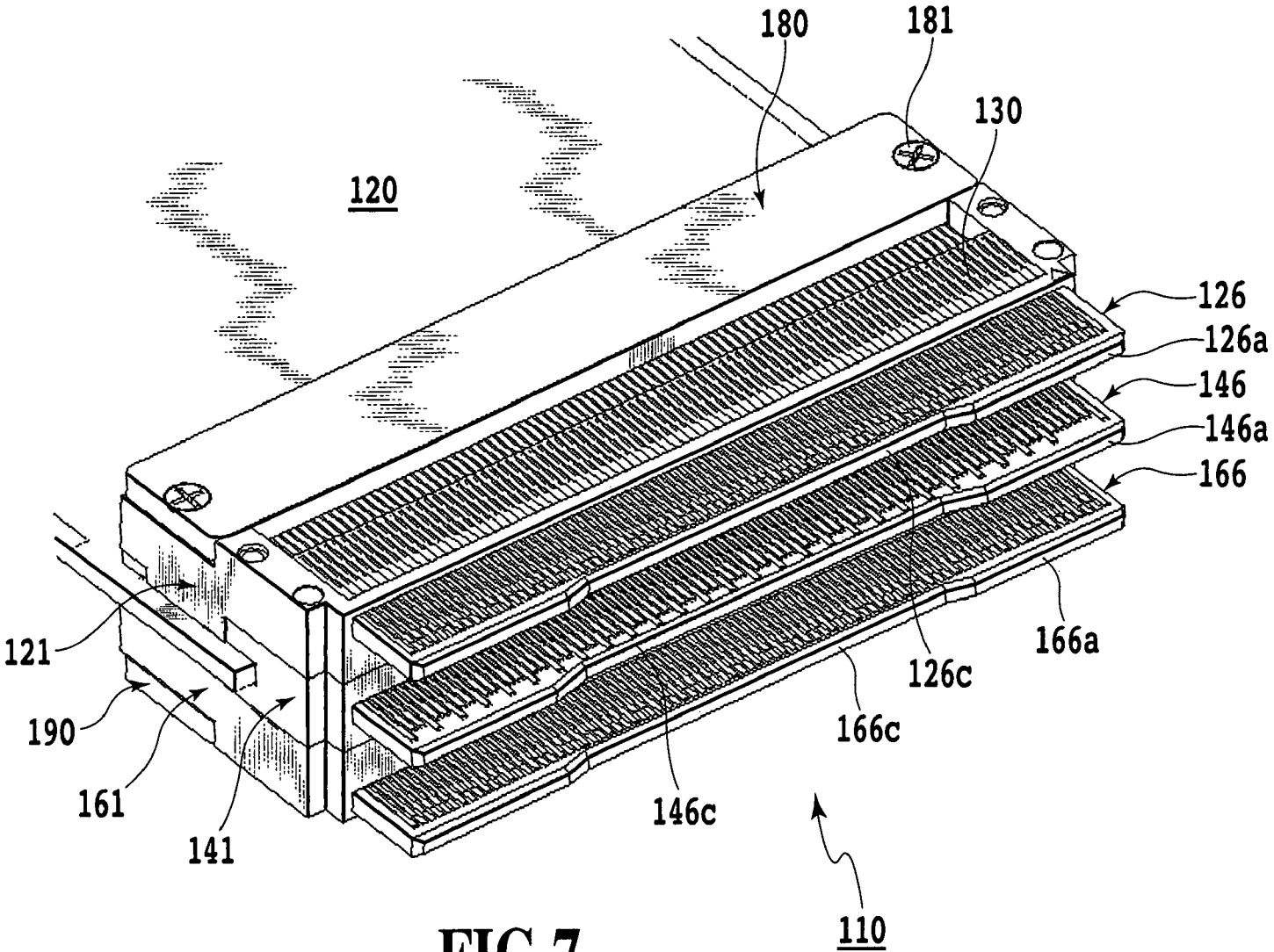
FIG. 7 is a schematic perspective view of a plug connector according to a second embodiment of the invention.

FIG. 7 shows a schematic perspective view of a plug connector 110 according to a second embodiment of the invention.

A plug connector 110 in this embodiment is mounted on one printed wiring board 120. As shown in FIG. 7, the printed wiring board 120 is provided, at the front thereof, with first, second and third connector-contact arrangements 121, 141, 161. The first, second and third connector-contact arrangements 121, 141, 161 are to be inserted to a card-edge connector (not shown) of a motherboard similarly to the first embodiment, thereby placing the printed wiring board 120 in electric connection with the motherboard.

The first and third connector-contact arrangements 121, 161 of this embodiment are quite the same in form and structure as the first connector-contact arrangement 21 of the first embodiment. Meanwhile, the second connector-contact arrangement 141 is quite the same in form and structure as the second connector 41 of the first embodiment.

The plug connector 110 in this embodiment is characterized in that the first connector-contact arrangement 121 is arranged on the printed wiring board 120, the second connector-contact arrangement 141 is at a front end of the printed wiring board 120 and the third connector-contact arrangement 161 is beneath the printed wiring board 120. Namely, as shown in FIG. 7, the first and third connector-contact arrangements 121, 161, common in form and structure, are arranged oppositely sandwiching the printed wiring board 120 and the second connector-contact arrangement 141.

The printed wiring board 120 and the first, second and third connector-contact arrangements 121, 141, 161 are assembled into one body by use of screws 181, together with a fixing portion 180 arranged on a rear portion of the first connector-contact arrangement 121 and a fixing portion 190 arranged beneath a rear portion of the third connector-contact arrangement 161, thus structuring a plug connector 110 having connector-contact arrangements in three levels. In this case, the first, second and third connector-contact arrangements 121, 141, 161 at their front walls, are naturally in flush one with another.

With this structure, signal lines can be connected with high density through the plug connector 110. Meanwhile, by oppositely arranging the first and third connector-contact arrangements 121, 161 on and beneath the printed wiring board 120, the lower fixing member required in the first embodiment can be omitted. Furthermore, because the printed wiring board 120 and the second connector-contact arrangement 141 are provided between the first and third connector-contact arrangements 121, 161, the plug connector 110 can be formed compact. Meanwhile, where connector-contact arrangements in three levels are provided for one printed wiring board 120, a small force is satisfactorily required for simultaneous insertion of the plug connector 110 to the card-edge connector similarly to the first embodiment. This makes it easy to exchange the printed wiring board.

Third Embodiment

Figure 9:
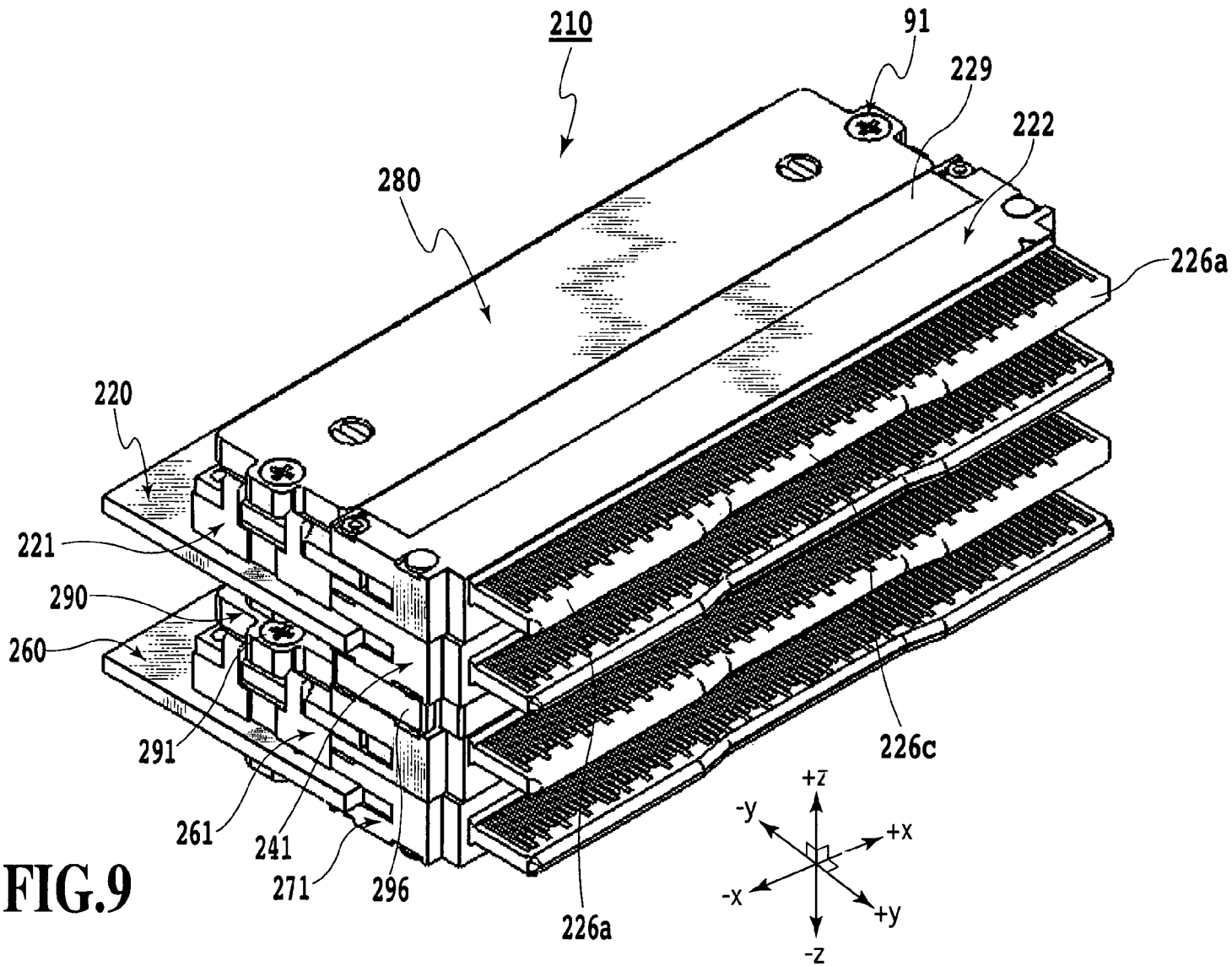
FIG. 9 is a schematic perspective view of a plug connector according to a third embodiment of the invention.
Figure 11:
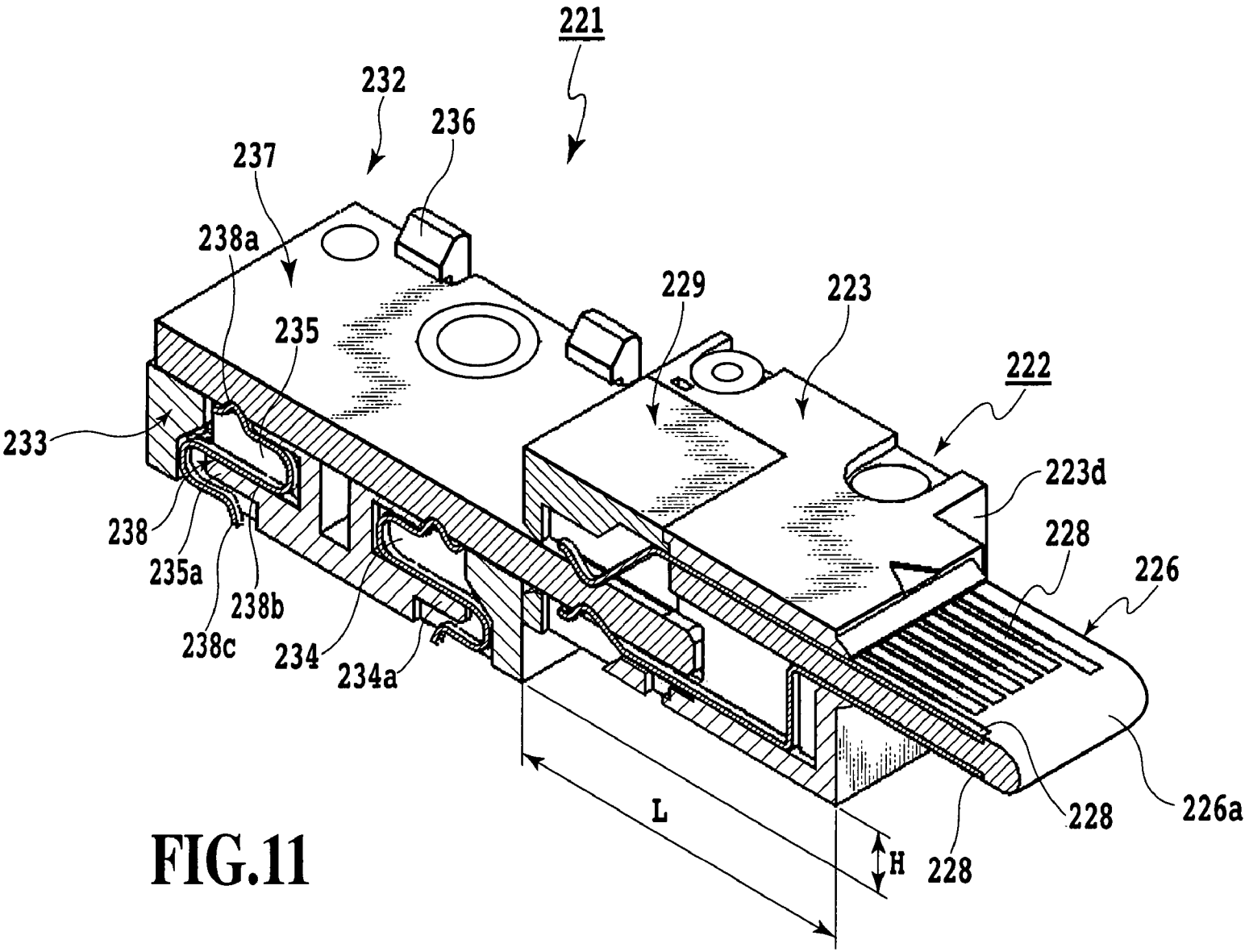
FIG. 11 is a schematic broken-away perspective view of a first connector-contact arrangement of the FIG. 9 plug connector.
Figure 12:
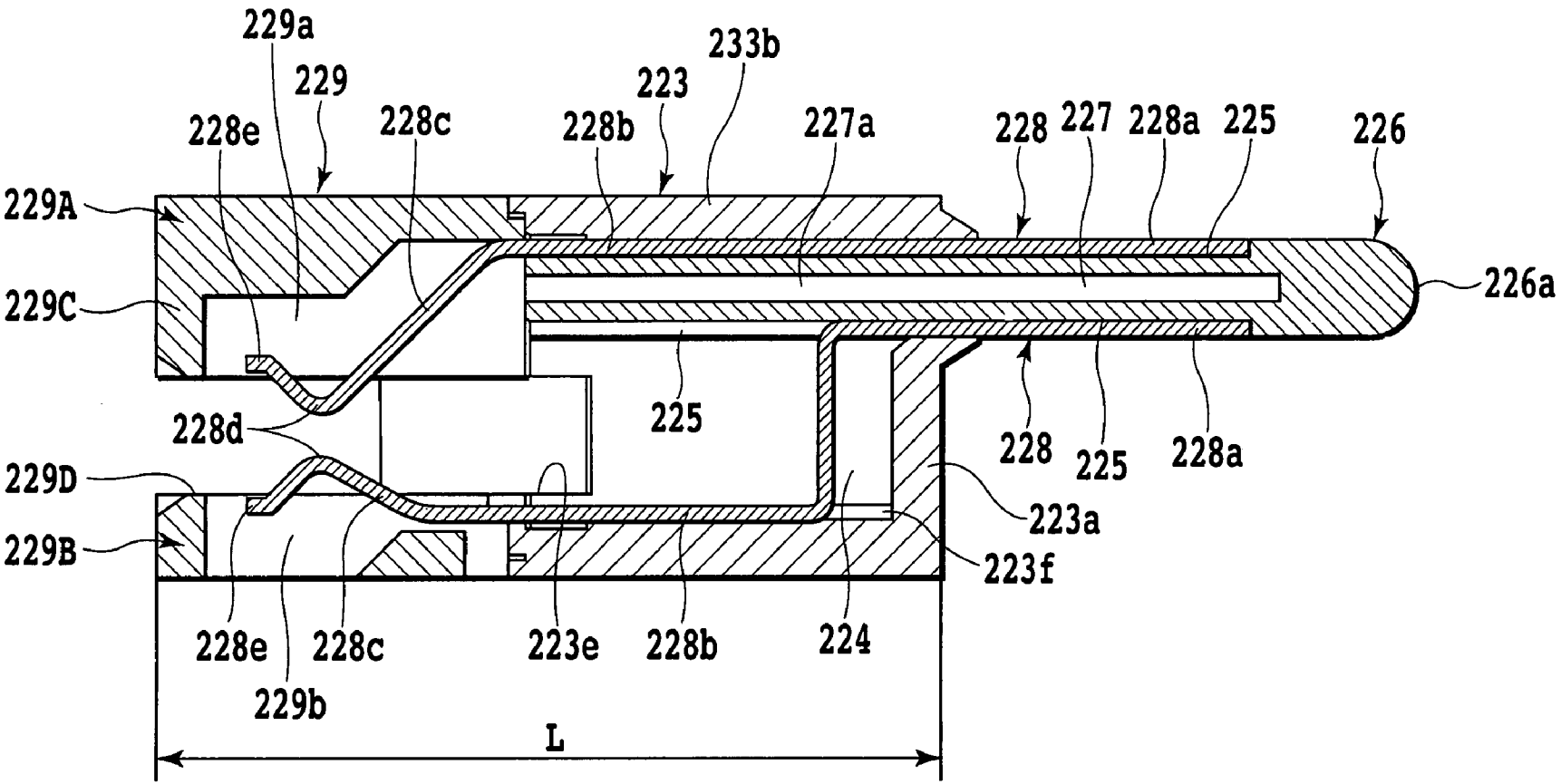
FIG. 12 is a schematic sectional view of a terminal component for the FIG. 11 first connector-contact arrangement.
Figure 13:
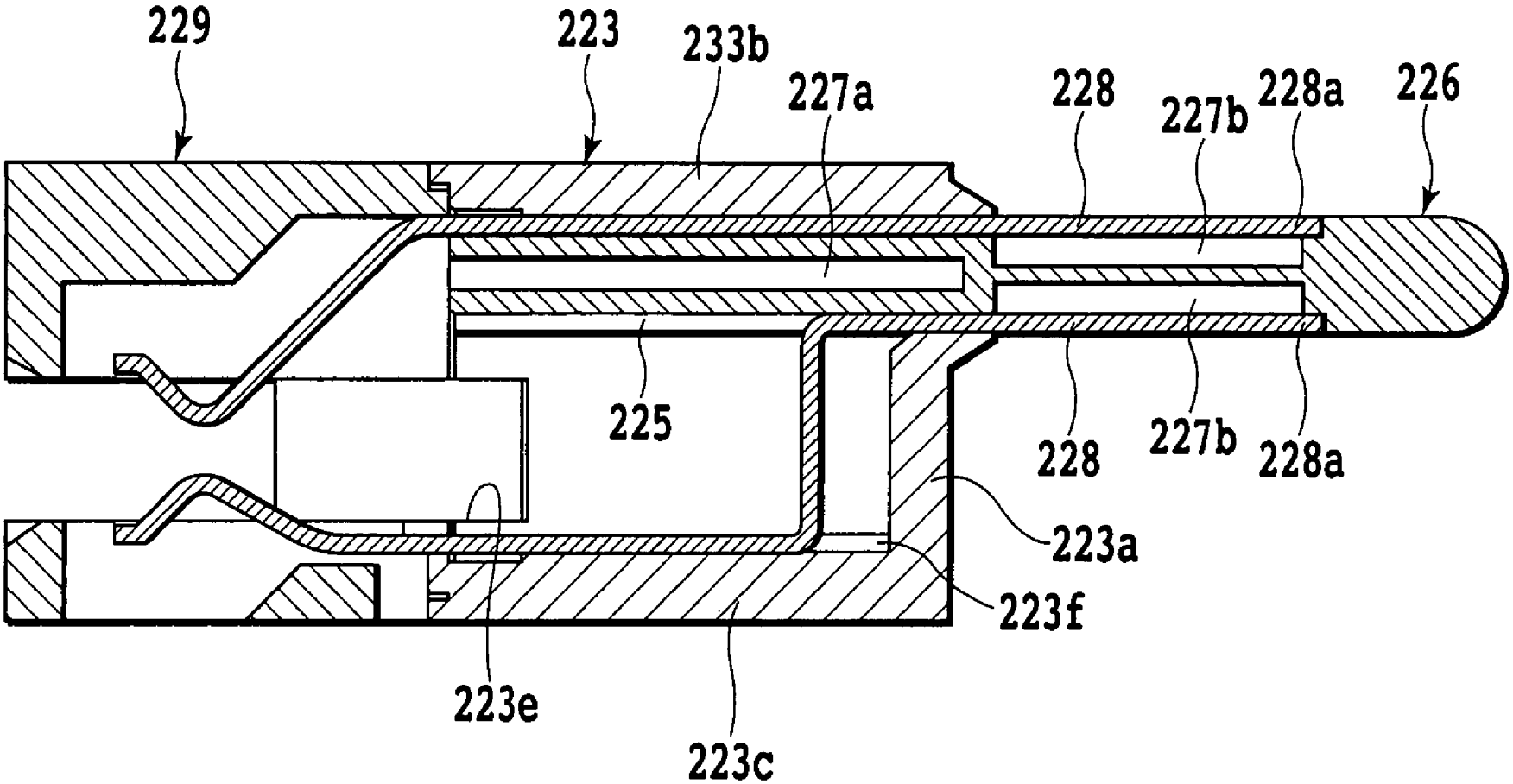
FIG. 13 is a schematic sectional view of another terminal component for the first connector-contact arrangement.

FIGS. 9 to 13 show schematic views of a plug connector 210 according to a third embodiment of the invention. FIG. 9 is a schematic perspective view of a plug connector according to the third embodiment. FIG. 10 is a schematic sectional view of the FIG. 9 plug connector. FIG. 11 is a schematic sectional view of a first connector-contact arrangement of the FIG. 9 plug connector. FIG. 12 is a schematic sectional view of a terminal component structuring the FIG. 11 first connector-contact arrangement. FIG. 13 is a schematic sectional view of another terminal component.

Note that, in the description, "left" and "right" are respectively in directions of +x and −x in FIG. 9, "front" and "rear" are respectively in directions of +y and −y, and "upper" and "lower" are respectively in directions of +z and −z, similarly to the first embodiment.

The plug connector 210 of this embodiment is quite the same as that of the first embodiment except for the sole difference in structure from the first connector-contact arrangement.

A plug connector 210 in a third embodiment is shown in its overview in FIGS. 9 and 10. Similarly to the first embodiment, the plug connector 210 includes first and second printed wiring boards 220, 260. For the first printed wiring board 220, provided are a first connector-contact arrangement 221 and a second connector-contact arrangement 241 at the front end thereof. The first and second connector-contact arrangements 221, 241 are to be inserted in a card-edge connector (not shown) of a motherboard (not shown), to place the first printed wiring board 220 in electrical connection with the motherboard. As shown in FIGS. 9 and 10, the first connector-contact arrangement 221 is arranged on the first printed wiring board 220 while the second connector-contact arrangement 241 is arranged at a front end of the first printed wiring board 220. The first printed wiring board 220 and the first and second connector-contact arrangements 221, 241 are built up into one body by use of screws 281, together with an upper fixing portion 280 arranged on a rear portion of the first connector-contact arrangement 221 and a lower fixing portion 285 arranged beneath the first printed wiring board 220 extending rearward beyond the second connector-contact arrangement 241, thus constituting a plug connector 210 having connector-contact arrangements 221, 241 in two levels.

Likewise, for the second printed wiring board 260, provided are a third connector-contact arrangement 261 and a fourth connector-contact arrangement 271 at the front end thereof. The second printed wiring board 260 and the third and fourth connector-contact arrangements 261, 271 are built up into one body by use of screws 291, together with upper and lower fixing portions 290, 295, thus structuring a plug connector having connector-contact arrangements in two levels.

In this embodiment, the assembly of the first printed wiring board 220 and the first and second connector-contact arrangements 221, 241 and the assembly of the second printed wiring board 260 and the third and fourth connector-contact arrangements 261, 271, are further built up into one body through a connecting member 296. As a result, the plug connector 210 in this embodiment has the connector-contact arrangements 221, 241, 261 and 271 in four levels. In this manner, the connector-contact arrangements are efficiently arranged to buildup a plug connector 210. This makes assembling easy and reduces the number of components required in assembling. Furthermore, despite the plug connector 210 in this embodiment is in such a simple structure, printed wiring boards having a multiplicity of external terminals can be simultaneously placed in electrical connection with the motherboard positively.

There is shown in FIGS. 10 and 11 the overview of the first connector-contact arrangement 221 featuring the plug connector 210 of this embodiment. The first connector-contact arrangement 221 roughly includes two components, i.e. a terminal component 222 arranged in the front and a connecting member 232 arranged in the rear of the terminal component 222. Namely, the first contact arrangement 221 in this embodiment is arranged longitudinally with the terminal component 222 and the connecting member 232, thereby possessing a structure similar to that of the first connector-contact arrangement 21 of the first embodiment.

The terminal component 222 in this embodiment has a case member 223, a plurality of first contact components 228 pressed in the case member 223 and a cover member 229. As shown in FIGS. 10, 11, the terminal component 222 is fit with a front end of a connecting wiring board 237 structuring the connecting member 232 arranged in the rear of the terminal component 222, thus being structured to electrically connecting between the signal lines and grounding pads of the board 234 and a first contact component 228 of the terminal component 222. In this respect, the terminal component 222 in this embodiment is substantially the same in structure as the second connector-contact arrangement 41 in the first embodiment.

The case member 223 is preferably formed of an electrically-insulating synthetic resin. The case member 223 includes a front wall 223*a*, a top wall 223*b*, a bottom wall 223*c*, right-and-left sidewalls 223*d* (FIG. 11), and a first blade 226. As shown in FIG. 12, a space rectangular in section is formed by the front wall 223, the top wall 223*b*, the bottom wall 223*c* and the sidewalls 223*d* wherein the space is opened rearward. Meanwhile, in the upper surface of the bottom wall 223*c*, a plurality of press-in grooves 223*f* longitudinally extend parallel one with another, to fix the plurality of first contact components 228. Incidentally, partition walls 224 may be formed in the space of the case member 223, to partition between adjacent ones of the press-in grooves 223*f*. Furthermore, in the right-and-left sidewalls 223*d*, cutouts 223*e* are formed to guide the front end of the connecting wiring board 237 structuring the connecting member 232. Meanwhile, the right-and-left sidewalls 223*d* extend rearward beyond the top and bottom walls 223*b*, 223*c*, thus supporting the cover member 229, referred later.

The first blade 226 in this embodiment has the same front-end form in outer shape as the front end 26*a* of the first blade 26 of the first-embodiment plug connector 10 in the first embodiment. Namely, in the front-end surface 226*a* of the first blade 226 of this embodiment, a recessed surface 226*c* is provided nearly centrally with respect to the right-to-left direction similarly to the first embodiment (see FIG. 9). The front-end surface 226*a*, of the first blade in this embodiment, is formed rounded in section, as shown in FIG. 12. The front-end surface 226*a* of the first blade 226 may be in such a sectional form as in this embodiment or formed with slant surfaces 26*a*, 46*a* along the upper and lower sides as in the first or second blade 26, 46 of the first embodiment. In brief, the blades 26, 46, 226 are satisfactorily structured to be easily inserted to the card-edge connector.

As shown in FIG. 12, the first blade 226 of the first connector-contact arrangement 221 projects frontward from an upper region of the front wall 223*a*. The projection amount of the first blade 226 from the front wall 223*a* is equal to the projection amount of the first-embodiment first blade 26 from the front wall 28 of the frame 22. The first blade 226, in this embodiment, has a rear portion extending at its upper surface along the lower surface of the top wall 223*b* of the case member 223 and reaching up to an opening end in the rear of the case member 223. By thus providing the first blade 226, the first blade 226 of this embodiment is arranged nearly in the same position, in respect of vertical relationship, as the first blade 26 of the first-embodiment first connector-contact arrangement 21. In the upper and lower surfaces of the present-embodiment first blade 226, fixing grooves 225 are formed to receive the first contact components 228 therein. The fixing grooves 225 are formed through the front wall 223*a*.

In the first blade 226 of this embodiment, a cavity 227 opened rearward is further formed between the fixing grooves 225 formed in the upper and lower surfaces thereof in order to prevent the crosstalk from occurring between the signal lines, similarly to the first-embodiment second blade. The cavity 227 is formed as a slit extending transverse the signal lines, i.e. first contact components 228, arranged parallel in the right-to-left direction. The cavity 227 may be formed as a pair of flat concaves 227*b* vertically opened in its portion projecting from the front wall 223*a* of the case member 223 as shown in FIG. 13. In this case, the first blade 226 may have a portion, extending in the space of the case member 223, formed with a slit-like cavity 227*a*. With this structure, because the first contact component 228 pressed in the fixing groove 225 is allowed to deform at its contact portion 228*a*, the first blade 226 is reduced of the inserting force when the first blade 226 is inserted to the card-edge connector.

Incidentally, the first blade 226 may be formed integral with the case member 223 or separately therefrom. In the case of forming a first blade 226 separately from the case member 223 in this manner, an opening is formed in the front wall 223*a* of the case member 223 so that the first blade 226 can be passed through. Furthermore, guide grooves are formed extending from the opening to the inner surfaces of the right-and-left sidewalls 223*d*. After attaching the first contact components 228 in the first blade 226, the first blade 226 at its right-and-left side regions may be fit in the guide grooves and fixingly assembled in the case member 223, as shown in FIG. 12. Otherwise, after assembled together with the first contact components 228 in the case member 223, the first blade 226 may be fixed in the case member 223 by heat fusion or bonding. This is true for the first embodiment.

The plurality of first contact components 228 structuring the terminal component 222 are formed of a conductive metal, which serve as signal-line or grounding conductors. Each of the first contact components 228 has a contact portion 228*a*, a fixing portion 228*b*, a resilient deformable portion 228*c*, a contact portion 228*d* and a rear-end portion 228*e*, as shown in FIG. 12.

The contact portion 228*a* and the fixing portion 228*b* of the first contact component 228, to be arranged upper in the first blade 226, are fit in the upper fixing groove 225 of the first blade 226. Accordingly, the contact portion 228*a* and the fixing portion 228*b* of the first contact component 228, to be arranged upper in the first blade 226, are formed continuous straight with respect to the horizontal direction. Meanwhile, the elastically deformable portion 228*c* of the first contact component 228, to be arranged upper in the first blade 226, is continuous with the horizontal fixing portion 228*b* and bent, in a rear of the fixing portion 228*b*, as a slant descending toward the rear, thus being formed elastically deformable. The rear-end portion 228*e* of the first contact component 228, to be arranged upper in the first blade 226, is continuous with the elastically deformable portion 228*c* and bent, together with the elastically deformable portion 228*c*, in a manner forming nearly a V-form. The bent point connecting between the elastically deformable portion 228*c* and the rear-end portion 228*e* is structured as a rounded contact portion 228*d*. The contact portion 228*d* is to be electrically contacted with a pad (not shown) that is an external terminal formed at the front end of the connecting wiring board 237 structuring the connecting member 232. When the contact component 228 is attached in the first blade 226, the elastic deformable portion 228*c*, the contact portion 228*d* and the rear-end portion 228*e* lie beyond the opening rear end of the case member 223, thus being arranged in the space of the cover member 229, referred later.

The contact portion 228*a* of the first contact component 228, to be arranged lower in the first blade 226, is fit in the lower fixing groove 225 of the first blade 226. The fixing portion 228*b* is fit in the press-in groove 223*f* formed in the bottom wall 223*c* of the case member 223. Accordingly, the contact portion 228*a* and the fixing portion 228*b* of the first contact component 228, to be arranged lower in the first blade 226, are parallel with each other and connected together in a manner forming a step, as shown in FIG. 12. The elastically deformable portion 228*c* of the first contact component 228, to be arranged lower in the first blade 226, is formed nearly symmetric with the elastically deformable portion 228*c* of the first contact component 228 to be arranged upper in the first blade 226. Specifically, the elastically deformable portion 228*c* of the first contact component 228, to be arranged lower in the first blade 226, is continuous with the horizontal fixing portion 228*b* and bent, in a rear of the fixing portion 228*b*, as a slant ascending toward the rear, thus being formed elastically deformable. The rear-end portion 228*e* of the first contact component 228, to be arranged lower in the first blade 226, is similarly formed nearly symmetric with the rear-end portion 228*e* of the first contact component 228 to be arranged upper in the first blade 226. The rear-end portion 228*e* of the first contact component 228, to be arranged lower in the first blade 226, is continuous with the elastically deformable portion 228*c* and bent, together with the elastically deformable portion 228*c*, in a manner forming nearly a V-form. The bent point connecting between the elastically deformable portion 228*c* and the rear-end portion 228*e* is structured as a rounded contact portion 228*d*. Accordingly, the contact portion 228*d* of the first contact component 228, to be arranged lower in the first blade 226, is arranged vertically opposite to the contact portion 228*d* of the first contact component 228 arranged upper in the first blade 226. The contact portion 228*d* of the first contact component 228, arranged lower in the first blade 226, is electrically contacted with a pad (not shown) that is an external contact formed at the front end of the connecting wiring board 237 structuring the connecting member 232. When the first contact component 228 is attached lower in the first blade 226, the elastic deformable portion 228*c*, the contact portion 228*d* and the rear-end portion 228*e* lie beyond the opening rear end of the case member 223, thus being arranged in the space of the cover member 229, referred later.

By arranging the first contact component 228 as in the above, the terminal component 222 when assembled as a plug connector 210 as shown in FIGS. 10 and 11 can be electrically connected with the pad that is an external terminal of the connecting wiring board 237 through clamp contact, referred later.

The cover member 229, structuring the terminal component 222, is connected to the case member 223 at its rear-opening end between the right-and-left sidewalls 223*d* extending rearward of the case member 223. The cover member 229 is formed with an upper member 229A and a lower member 229B. The upper and lower members 229A, 229B of the cover member 229 are fixed to the case member 223 by being inserted until the front surfaces of the upper and lower members 229A, 229B go into abutment against the rear-end surface of the top and bottom wall 223*b*, 223*c* through mount grooves 223*e* formed upper and lower in the extended portions of the right-and-left sidewalls 223*d*. Specifically, the upper and lower members 229A, 229B are held in the case member 223 by fitting the claws (or engaging recesses, not shown) formed in the upper and lower members 229A, 229B with the engaging recesses (or claws) 223*f* formed in the mount grooves 223*e* of the case member 223. In each of the upper and lower members 229A, 229B, partitions 229*a*, 229*b* are formed correspondingly to the partition walls 224 of the case member 223. Accordingly, when the cover member 229 is assembled in the case member 223, the elastically deformable portion 228*c*, contact portion 228*d* and rear-end portion 228*e* of the first contact component 228 is placed between the partitions 229*a*, 229*b* formed in each of the upper and lower members 229A, 229B of the cover member 229.

The cover member 229 has a space continuing the space formed in the case member 223, which space is closed by the rear wall 229C formed in the upper member 229A. Between the upper and lower members 229A, 229B, there are formed openings 229*b* corresponding to the cutouts 223*e* of the case member 223, to receive the connecting wiring board 237 structuring the connecting member 232.

Meanwhile, the connecting member 232, structuring the present-embodiment first connector-contact arrangement 221, includes a contact-receiving member 233, a connecting wiring board 237 and a plurality of connecting contacts 238.

The contact-receiving member 233 is in a rectangular parallelepiped form generally flat in section, and formed of an electrically-insulating synthetic resin. The contact-receiving member 233 has a top surface formed with hooks 236, projecting upward at right-and-left side regions thereof, in order to fix the connecting wiring board 237 on a top surface of the contact-receiving member 233.

The contact-receiving member 233 is also formed with two contact-receiving chambers 234, 235 arranged longitudinally of the contact-receiving member 233 and for receiving connecting contacts 238 therein. The two contact-receiving chambers 234, 235 are structurally symmetric with respect to the longitudinal direction, as shown in FIGS. 10 and 11. This, however, is not limitative. The reason of providing two contact-receiving chambers is because the present embodiment requires connecting contacts by which the circuits (signal lines) printed in the same position on the main and back surfaces of the connecting wiring board 237 are respectively connected to the pads of the circuits printed in the same position on the back and main surfaces of the printed wiring board 220. Specifically, as shown in FIG. 10, by the connecting contact 238 arranged in the contact-receiving chamber 234 formed in the front, electric connection is provided between the pad for the circuit printed on the lower surface of the connecting wiring board 237 and the pad for the circuit printed on the lower surface of the printed wiring board 220. Meanwhile, by the connecting contact 238 arranged in the contact-receiving chamber 235 formed in the rear, electric connection is provided between the pad for the circuit printed on the upper surface of the connecting wiring board 237 and the pad for the circuit printed on the upper surface of the printed wiring board 220. For this reason, where the printed wiring board 220 and the motherboard are connected by one signal line, the contact-receiving chamber is satisfactorily provided one in the number.

In each of the contact-receiving chambers 234, 235, a fixing protuberance 234*a*, 235*a* is provided in an intermediate position with respect to the vertical direction. A plurality of press-in grooves (not shown) are formed extending longitudinally in the upper surface of the fixing protuberance 234*a*, 235*a*, to fix the connecting contact 238. Consequently, in the two contact-receiving chambers 233*a*, 233*b*, connecting contacts 238 are arranged parallel at the same pitch as the arrangement pitch of the first contact components 228. In order to prevent the contact between the connecting contacts 238 arranged in each of the contact-receiving chambers 234*a*, 235*a*, partition walls may be provided similarly to those in the space of the case member 223 structuring the terminal component 222.

The connecting contact 238, received in the contact-receiving chamber 234, 235, is formed of a metal the same in conductivity to the first contact component 228. The connecting contacts 238 received in the contact-receiving chambers 234, 235 are arranged symmetric as shown in FIG. 10 wherein it would be understood that those have substantially the same shape. Accordingly, in the description, explanation is made on the connecting contact 238 received in the contact-receiving chamber 235.

The connecting contact 238 is a conductor that assumes generally an S-form and includes an upper contact portion 238*a*, a fixing portion 238*b* and a lower contact portion 238*c*, as shown in FIG. 10. The upper contact portion 238*a* is arranged to project upward from the upper surface of the contact-receiving chamber 235 (more specifically, upper surface of the connecting member 232), which is vertically deformable and placed in contact with the pad (not shown) that is an external terminal of a printed circuit on a connecting wiring board 237, referred later. The fixing portion 238*b* is pressed in the press-in groove provided in the fixing protuberance 235*a* of the contact-receiving chamber 235. Due to this, the connecting contacts 238 in an adjacent relationship are arranged parallel with each other. The lower contact portion 238*c* is arranged to project downward from the lower surface of the contact-receiving chamber 235 (more specifically, lower surface of the connecting member 232), which is vertically deformable and placed in contact with the pad (not shown) that is an external terminal of a printed circuit on a printed wiring board 220. Accordingly, when assembled as a plug connector 210, the upper and lower contact portions 238*a*, 238*c* are respectively pushed or pressed into contact with the pad of the connecting wiring board 237 and the pad of the printed wiring board 220.

The connecting wiring board 237, structuring the connecting member 232, is provided with printed circuits (signal lines, etc.) on the main and back surfaces thereof, to electrically connect between the first contact component 228 structuring the terminal component 223 and the connecting contact 238 structuring the connecting member 232. By being pushed from above of the contact-receiving member 233, the connecting wiring board 237 is fixed onto the upper surface of the contact-receiving member 233 through the hook 236. On this occasion, the connecting wiring board 237 protrudes at its front from the front surface of the contact-receiving member 233. The amount of forward projection of the connecting wiring board 237 is set to such a length that the connecting wiring board 237 at its front end abuts against the cutout 223*e* formed in the case member 223 of the terminal component 222.

By inserting the connecting wiring board 237 of the connecting member 232, at its tip, up to the cutout 223*c* of the case member 223 through the opening 229 of the cover member 229 of the terminal component 222, formed is a first connector-contact arrangement 221 in the present embodiment. At this time, a step is formed, as shown in FIG. 11, between a bottom surface of the contact-receiving member 233 structuring the connecting member 232 and a bottom surface of the case member 223 structuring the terminal component 222. The distance between the bottom surfaces, i.e. step height H, is provided equal to the distance (height) m1, m2 (see FIGS. 6 and 10) from the cutout formed in the sidewall of the second connector-contact arrangement 241 to the upper surface of the top wall and to the lower surface of the bottom wall, similarly to the first embodiment.

Meanwhile, the second connector-contact arrangement 241 of this embodiment is quite the same in structure as the second connector-contact arrangement 41 shown in the first embodiment, and hence omitted to explain.

The plug connector 210 of this embodiment, having the structure described so far, is allowed to assume an assembly structure similar to that of the first-embodiment plug connector 10. Likewise, it also is allowed to assume an assembly structure shown as the plug connector 110 in the second embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A plug connector, for electrically connecting a printed wiring board with a card-edge connector, comprising:

a first connector-contact arrangement that is inserted to a card-edge connector, and that includes a first blade with a front surface having a recessed surface partly recessed therefrom and a plurality of first contact components arranged parallel one with another in the first blade;

a second connector-contact arrangement that is inserted to a card-edge connector, and that includes a second blade with a front surface having a recessed surface partly recessed therefrom and a plurality of second contact components arranged parallel one with another in the second blade;

wherein, when a plug connector is formed by assembling the first and second connector-contact arrangements together, the first connector-contact arrangement is electrically connected with one printed wiring board through press-contact or push-contact while the second connector-contact arrangement is electrically connected therewith through clamp-contact.

2. A plug connector as claimed in claim 1, wherein, in the front-end surface of the first blade, the width of the front-end surface in which the recessed surface is not formed and that of the recessed surface are configured such that the number of the contact components corresponding to the front-end surface in which the recessed surface is not formed and the number of the contact components corresponding to the recessed surface are equal to each other.

3. A plug connector as claimed in claim 1, wherein the first connector-contact arrangement further includes a frame, the first blade being formed as a part of the frame, the first contact components being arranged parallel one with another in the frame, the second connector-contact arrangement further including a case, the second blade being formed as a part of the case, the second contact components being arranged parallel one with another in the case.

4. A plug connector as claimed in claim 3, wherein the frame, structuring the first connector-contact arrangement, includes right-and-left first sidewalls, right-and-left second sidewalls respectively provided upper front of the right-and-left first sidewalls through steps, front and bottom walls connecting between the right-and-left second sidewalls, and the first blade formed protruding frontward from the front wall, the first blade being formed with a plurality of slits, the plurality of slits being formed through the front wall and communicating with a space formed by the right-and-left second sidewalls, the front wall and the bottom wall of the frame, the case, structuring the second connector-contact arrangement, including a top wall, a bottom wall, right-and-left sidewalls, a front wall closing frontward a space formed by the top wall, the bottom wall and the right-and-left sidewalls, and the second blade formed protruding frontward from the front wall, the second blade being formed with a plurality of fixing grooves paired in upper and lower surfaces thereof, the fixing grooves being in communication with the space of the case.

5. A plug connector as claimed in claim 4, wherein the first contact component of the first connector-contact arrangement includes two conductors, a projection piece that is formed of an insulating material and that external terminals as tips of the two conductors to be contacted with a card-edge connector are arranged in upper and lower surfaces thereof, first and second fixing portions each burying the two conductors in an insulating material, a non-fixing portion provided between the first and second fixing portions and exposing the two conductors, and an elastically-deformable contact portion to be press-contacted with an external terminal provided in a surface of the printed wiring board, the projection piece of the first contact component being arranged in the slit of the first blade of the frame, the first fixing portion of the first contact component being arranged in a space formed by the right-and-left second sidewalls, the front wall and the bottom wall of the frame, the second fixing portion of the first contact component being arranged in the frame between the right-and-left first sidewalls, thereby forming the first connector-contact arrangement, the second contact component of the second connector-contact arrangement being a conductor including an external terminal to contact with the card-edge connector, a fixing portion to be pressed in a case and an elastically-deformable contact portion to contact with the printed wiring board, a plurality of the conductors being arranged parallel one with another and paired vertically in the case thereby forming the second connector-contact arrangement.

6. A plug connector as claimed in claim 5, wherein a cavity is formed in the projection piece of the first contact component of the first connector-contact arrangement between the conductors arranged in the upper and lower surfaces thereof, the second blade of the second connector-contact arrangement being formed with a cavity between the conductors arranged upper and lower.

7. A plug connector as claimed in claim 1, wherein the first connector-contact arrangement has a terminal component including a case member having a front wall, a top wall, a bottom wall, right-and-left sidewalls and a first blade, a plurality of first contact components and a cover member, and a connecting member including a connecting wiring board, a contact-receiving member and a plurality of connecting contacts, the first blade being formed protruding frontward from the front wall structuring the case member, the first blade being formed, in upper and lower surfaces thereof, with a plurality of fixing grooves paired vertically and parallel one with another each of which communicates with a space formed by the front wall, the top wall, the bottom wall and the right-and-left sidewalls of the case member, the first contact component being a conductor including an external terminal to contact with a card-edge connector, a fixing portion to be pressed in the case member, and an elastically-deformable contact portion structuring the connecting member and to contact with the connecting wiring board, the first contact components being arranged parallel one with another in the case member, the contact-receiving member being formed with a plurality of contact-receiving chambers to receive therein the connection contacts in a manner vertically penetrating the contact-receiving member, the connecting contact being a conductor including an elastically-deformable upper contact portion to contact with an external terminal of the connecting wiring board, a fixing portion to be pressed in a press-in groove of a fixing protuberance provided in the contact-receiving chamber, and an elastically-deformable lower contact portion to contact with an external terminal of the printed wiring board, the connecting wiring board being arranged extending frontward furthermore from an upper region of the contact-receiving chamber.

8. A plug connector as claimed in claim 7, wherein the second connector-contact arrangement has a case and second contact components, the case including a top wall, a bottom wall, right-and-left sidewalls, a front wall closing frontward a space formed by the top wall, the bottom wall and right-and-left sidewalls, and the second blade formed protruding frontward from the front wall, the second blade being formed with a plurality of fixing grooves pared in upper and lower surfaces thereof, the fixing grooves communicating with the space of the case, the second contact component being a conductor including an external terminal to contact with a card-edge connector, a fixing portion pressed in the case, and an elastically-deformable contact portion to contact with the printed wiring board, the conductors in plurality being arranged parallel one with another in the case and paired vertically thereby forming the second connector-contact arrangement.

9. A plug connector as claimed in claim 8, wherein a cavity is formed between the conductors arranged upper and lower of the first blade of the first connector-contact arrangement, a cavity being formed also between the conductors arranged upper and lower of the second blade of the second connector-contact arrangement.

10. A plug connector as claimed in claim 1, wherein two of the first connector-contact arrangements are oppositely arranged in a manner sandwiching one of the printed wiring board and one of the second connector-contact arrangement, thus having contact arrangement in three levels.

11. A plug connector as claimed in claim 1, wherein one of the first connector-contact arrangement is arranged over one of the printed wiring board and one of the second connector-contact arrangement to thereby forming a plug connector having contact arrangement in two levels, two of the plug connectors being connected vertically through a connecting member thus having contact arrangements in four levels.

* * * * *